US011035086B2

(12) United States Patent
De La Chevrotiere

(10) Patent No.: US 11,035,086 B2
(45) Date of Patent: Jun. 15, 2021

(54) STRUCTURAL ASSEMBLIES FOR CONSTRUCTING BRIDGES AND OTHER STRUCTURES

(71) Applicant: Alexandre De La Chevrotiere, Montreal (CA)

(72) Inventor: Alexandre De La Chevrotiere, Montreal (CA)

( * ) Notice: Subject to any disclaimer, the term of this patent is extended or adjusted under 35 U.S.C. 154(b) by 178 days.

(21) Appl. No.: 16/236,763

(22) Filed: Dec. 31, 2018

(65) Prior Publication Data

US 2019/0276995 A1 Sep. 12, 2019

Related U.S. Application Data

(63) Continuation of application No. 14/204,735, filed on Mar. 11, 2014, now abandoned, which is a continuation of application No. 13/122,955, filed as application No. PCT/CA2009/001404 on Oct. 6, 2009, now Pat. No. 8,667,633.

(Continued)

(51) Int. Cl.

| | |
|---|---|
| ***E01D 19/00*** | (2006.01) |
| ***E01D 6/00*** | (2006.01) |
| ***F21V 33/00*** | (2006.01) |
| ***E01D 15/133*** | (2006.01) |

(Continued)

(52) U.S. Cl.

CPC ..... *E01D 6/00* (2013.01); *E01D 15/133* (2013.01); *E01D 19/00* (2013.01); *E04B 1/1903* (2013.01); *F21V 33/006* (2013.01); *F21Y 2115/10* (2016.08)

(58) Field of Classification Search

CPC ..... E01D 6/00; E01D 19/00; E04B 1/1903

See application file for complete search history.

(56) References Cited

U.S. PATENT DOCUMENTS

| | | | |
|---|---|---|---|
| 16,579 | A | 2/1857 | Comins |
| 25,852 | A | 10/1859 | Sprague |

(Continued)

FOREIGN PATENT DOCUMENTS

| | | | |
|---|---|---|---|
| CA | 2271403 | A1 | 10/2000 |
| CA | 2688813 | A1 | 4/2010 |

(Continued)

OTHER PUBLICATIONS

Canadian Examiner's Report dated Jan. 30, 2017 in CA Patent Application No. 2,688,813, 3 pages.

(Continued)

*Primary Examiner* — Gary S Hartmann

(74) *Attorney, Agent, or Firm* — Wilmer Cutler Pickering Hale and Dorr LLP

(57) ABSTRACT

Structural assemblies for constructing bridges and other structures. A structural assembly may comprise an elongated member defining an internal space. The structural assembly may also comprise a plurality of framing members connected to the elongated member at a plurality of pin connection nodes, each pin connection node comprising a pin interconnecting the elongated member, a first one of the framing members, and a second one of the framing members, the pin having a first longitudinal end and a second longitudinal end, at least one of the first longitudinal end and the second longitudinal end of the pin being located in the internal space of the elongated member.

26 Claims, 21 Drawing Sheets

Related U.S. Application Data

(60) Provisional application No. 61/103,181, filed on Oct. 6, 2008.

(51) Int. Cl.
*E04B 1/19* (2006.01)
*F21Y 115/10* (2016.01)

(56) References Cited

U.S. PATENT DOCUMENTS

| | | | |
|---|---|---|---|
| 117,047 | A | 7/1871 | Clarke et al. |
| 117,049 | A | 7/1871 | Clarke et al. |
| 187,513 | A | 2/1877 | Colby |
| 515,445 | A | 2/1894 | Prasil |
| 693,259 | A | 2/1902 | Gilbert |
| 1,264,227 | A | 4/1918 | Uhl |
| 1,460,928 | A | 7/1923 | Tilden |
| 1,500,235 | A | 7/1924 | Clark |
| 1,554,224 | A | 9/1925 | McGrath |
| 1,792,489 | A | 2/1931 | Gilmore |
| 2,516,020 | A | 7/1950 | Reed |
| 2,696,139 | A | 12/1954 | Attwood |
| 2,764,108 | A | 9/1956 | Ronald |
| 2,839,320 | A | 6/1958 | Hill |
| 3,562,994 | A | 2/1971 | Linsowe |
| 3,591,995 | A | 7/1971 | Troutner |
| 3,834,549 | A | 9/1974 | Burg et al. |
| 3,901,613 | A | 8/1975 | Andersson |
| 4,007,507 | A | 2/1977 | Hansen |
| 4,069,635 | A | 1/1978 | Gilb |
| 4,104,843 | A | 8/1978 | Gilb |
| 4,116,106 | A | 9/1978 | Barbour |
| 4,120,065 | A | 10/1978 | Sivachenko et al. |
| 4,129,975 | A | 12/1978 | Gabriel |
| 4,136,985 | A | 1/1979 | Taul |
| 4,155,150 | A | 5/1979 | Oehmsen et al. |
| 4,161,769 | A | 7/1979 | Elliott |
| 4,589,693 | A | 5/1986 | Kennedy |
| 4,822,199 | A | 4/1989 | Nehls |
| 4,912,795 | A | 4/1990 | Johnson |
| 4,915,462 | A | 4/1990 | Le Marchand et al. |
| 4,945,595 | A | 8/1990 | Meriweather |
| 4,965,903 | A | 10/1990 | Bish |
| 5,000,211 | A | 3/1991 | Speare et al. |
| 5,145,278 | A | 9/1992 | Lohrmann |
| 5,200,240 | A | 4/1993 | Baker |
| 5,282,767 | A | 2/1994 | Gelardi |
| 5,414,885 | A | 5/1995 | Berlin et al. |
| 5,421,273 | A | 6/1995 | Lin |
| 5,526,614 | A | 6/1996 | Huang |
| 5,651,154 | A | 7/1997 | Ahlskog et al. |
| 5,724,691 | A | 3/1998 | Wiedeck et al. |
| 5,904,437 | A | 5/1999 | Allen |
| 5,924,152 | A | 7/1999 | Maier |
| 5,956,917 | A | 9/1999 | Reynolds |
| 6,009,586 | A | 1/2000 | Hawkes et al. |
| 6,056,240 | A | 5/2000 | Hagenlocher |
| 6,062,761 | A | 5/2000 | Allen |
| 6,116,437 | A | 9/2000 | Rowe |
| 6,308,357 | B1 | 10/2001 | Maier et al. |
| 6,631,530 | B1 | 10/2003 | Makofsky |
| 6,672,654 | B2 | 1/2004 | Yamada et al. |
| 6,887,009 | B1 | 5/2005 | Lopez |
| 7,300,080 | B2 | 11/2007 | Rebuffet et al. |
| 7,568,253 | B2 | 8/2009 | de la Chevrotiere |
| 7,882,586 | B2 | 2/2011 | de la Chevrotiere |
| 8,590,084 | B2 | 11/2013 | de la Chevrotiere |
| 8,667,633 | B2 | 3/2014 | De La Chevrotiere |
| 2002/0152715 | A1 | 10/2002 | Rotheroe |
| 2007/0008732 | A1 | 1/2007 | Robertson et al. |
| 2008/0201874 | A1 | 8/2008 | Coyle et al. |
| 2009/0255066 | A1 | 10/2009 | Brock |
| 2011/0146193 | A1 | 6/2011 | de la Chevrotiere |
| 2014/0190095 | A1 | 7/2014 | De La Chevrotiere |

FOREIGN PATENT DOCUMENTS

| | | | |
|---|---|---|---|
| DE | 10 2007 048 099 | A1 | 4/2009 |
| EP | 1 918 480 | A2 | 5/2008 |
| GB | 2 222 188 | A | 2/1990 |
| JP | 2001140355 | A | 5/2001 |
| RU | 2188287 | C2 | 8/2002 |
| WO | WO-2006/119642 | A1 | 11/2006 |
| WO | WO-2010/040205 | A1 | 4/2010 |

OTHER PUBLICATIONS

Canadian Examiner's Report dated Sep. 16, 2015 in CA Patent Application No. 2,688,813, 4 pages.

Canadian Notice of Allowance dated Dec. 11, 2018 in CA Patent Application 2,688,813, 1 page.

International Search Report for International Application No. PCT/CA2009/001404, dated Oct. 6, 2009, 6 pages.

Kosteas, Dimitri et al. "Modular Pedestrian Bridge in Aluminium." in 5 *Papers on Aluminium Bridges*. Technische Universitat Munchen Institut Fur Tragwerksbau Fachgebeit fur Leichtmetallbau and Ermudung, TRB Conference, Jan. 9-13, 2000, Washington DC, USA. pp. 1-10.

United States Office Action dated Jun. 8, 2011 in U.S. Appl. No. 12/976,617, 35 pages.

United States Office Action dated Jun. 8, 2012 in U.S. Appl. No. 12/976,617, 7 pages.

United States Final Office Action dated Jun. 17, 2016 in U.S. Appl. No. 14/204,735, 6 pages.

United States Notice of Allowance dated Jul. 29, 2013 in U.S. Appl. No. 12/976,617, 6 pages.

United States Notice of Allowance dated Oct. 23, 2013 in U.S. Appl. No. 13/122,955, 15 pages.

United States Office Action dated Apr. 11, 2013 in U.S. Appl. No. 13/122,955, 13 pages.

United States Office Action dated Jan. 3, 2012 in U.S. Appl. No. 12/976,617, 9 pages.

United States Office Action dated Jan. 30, 2013 in U.S. Appl. No. 12/976,617, 16 pages.

United States Office Action dated Oct. 7, 2015 in U.S. Appl. No. 14/204,735, 8 pages.

United States Restriction Requirement dated Jul. 20, 2015 in U.S. Appl. No. 14/204,735, 6 pages.

United States Restriction Requirement dated Sep. 28, 2012 in U.S. Appl. No. 13/122,955, 6 pages.

Written Opinion of the International Searching Authority, for International Application No. PCT/CA2009/001404, dated Feb. 1, 2010, 7 pages.

STRUCTURAL ASSEMBLIES FOR CONSTRUCTING BRIDGES AND OTHER STRUCTURES

CROSS-REFERENCE TO RELATED APPLICATION

This application is a continuation of U.S. patent application Ser. No. 14/204,735 filed on Mar. 11, 2014, which is a continuation of U.S. patent application Ser. No. 13/122,955 filed on Apr. 6, 2011, now U.S. Pat. No. 8,667,633, which is a National Phase of International Patent Application No. PCT/CA2009/001404 filed on Oct. 6, 2009, which claims priority from U.S. Provisional Patent Application No. 61/103,181 filed on Oct. 6, 2008, all of which are incorporated by reference herein.

FIELD OF THE INVENTION

The invention relates to structural assemblies for constructing bridges and other structures.

BACKGROUND

Bridges, including pedestrian bridges and vehicular bridges, have a wide range of applications. For example, pedestrian bridges can be used in skywalks between buildings, gangways to embark or disembark ships and other vehicles, elevated walkways in architectural interiors, boardwalks, and any other setting where people move.

Currently, pedestrian bridges are often formed of welded components. Such bridges tend to be complicated and potentially expensive to assemble and often need to be transported to their site pre-assembled. Where welded bridges are assembled on-site, as may be the case in larger structures, assembly can be laborious, expensive and complicated, requiring intervention of highly-skilled welders and other professionals. Also, such bridges tend to be permanent, since their assembly is generally irreversible and they sometimes can only be removed by destructive deconstruction.

Pedestrian bridges that are not welded or that are generally disassemblable tend to suffer from a number of drawbacks, including being susceptible to vandalism, tampering, and accidental disassembly. Such acts can have devastating consequences, particularly in cases of bridges that can fail and cause human loss if intentionally or unintentionally weakened or disassembled. Additionally, such bridges tend to have highly visible weld lines which are detrimental to their aesthetic appeal.

Similar considerations can also arise in vehicular bridges. Furthermore, similar considerations can also arise in other types of structures, such as buildings, fences, towers (e.g., antennae tower), gantries (e.g., motorway gantries, crane gantries, etc.), to name a few.

For these and other reasons, there is a need for improvements in structural assemblies for constructing bridges and other structures.

SUMMARY OF THE INVENTION

According to a first broad aspect, the invention provides a structural assembly. The structural assembly comprises an elongated member defining an internal space. The structural assembly also comprises a plurality of framing members connected to the elongated member at a plurality of pin connection nodes, each pin connection node comprising a pin interconnecting the elongated member, a first one of the framing members, and a second one of the framing members, the pin having a first longitudinal end and a second longitudinal end, at least one of the first longitudinal end and the second longitudinal end of the pin being located in the internal space of the elongated member.

According to a second broad aspect, the invention provides a structural assembly comprising an elongated member defining an internal space. The structural assembly also comprises a plurality of framing members connected to the elongated member at a plurality of nodes. The structural assembly further comprises a support for supporting an illumination system, the illumination system comprising a lighting device for emitting light from the elongated member, at least part of the lighting device being located in the internal space when the support supports the illumination system.

According to a third broad aspect, the invention provides a bridge comprising a first chord defining an internal space. The bridge also comprises a second chord. The bridge further comprises a plurality of web members connected to the first chord at a plurality of pin connection nodes and to the second chord at a plurality of moment-transferring connection nodes. Each pin connection node comprises a pin interconnecting the first chord, a first one of the web members, and a second one of the web members, the pin having a first longitudinal end and a second longitudinal end, at least one of the first longitudinal end and the second longitudinal end of the pin being located in the internal space of the first chord.

According to a fourth broad aspect, the invention provides a bridge comprising a first chord and a second chord and a plurality of web members connected to the first chord at a first plurality of nodes and to the second chord at a second plurality of nodes. Each node of the first plurality of nodes is a pin connection node, the pin connection node comprising a pin interconnecting the first chord, a first one of the web members, and a second one of the web members, the pin being concealed from view for an observer on the bridge.

According to a fifth broad aspect, the invention provides a bridge comprising a first chord defining an internal space and a second chord. The bridge also comprises a plurality of web members connected to the first chord at a first plurality of nodes and to the second chord at a second plurality of nodes. The bridge further comprises a support for supporting an illumination system, the illumination system comprising a lighting device for emitting light from the first chord, at least part of the lighting device being located in the internal space when the support supports the illumination system.

According to a sixth broad aspect, the invention provides a bridge comprising a first chord and a second chord. The bridge also comprises a plurality of web members connected to the first chord at a first plurality of nodes and to the second chord at a second plurality of nodes. Each web member has a central longitudinal axis and comprises a plurality of interior channels, the interior channels receiving a plurality of fasteners each having a longitudinal axis generally parallel to the central longitudinal axis of the web member, the fasteners being adjacent to one another along a direction transverse to the central longitudinal axis of the web member.

According to a seventh broad aspect, the invention provides a structural assembly. The structural assembly comprises an elongated member and a plurality of framing members connected to the elongated member at a plurality of pin connection nodes. Each pin connection node comprises a pin interconnecting the elongated member, a first one of the framing members, and a second one of the framing members, the pin being concealed.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
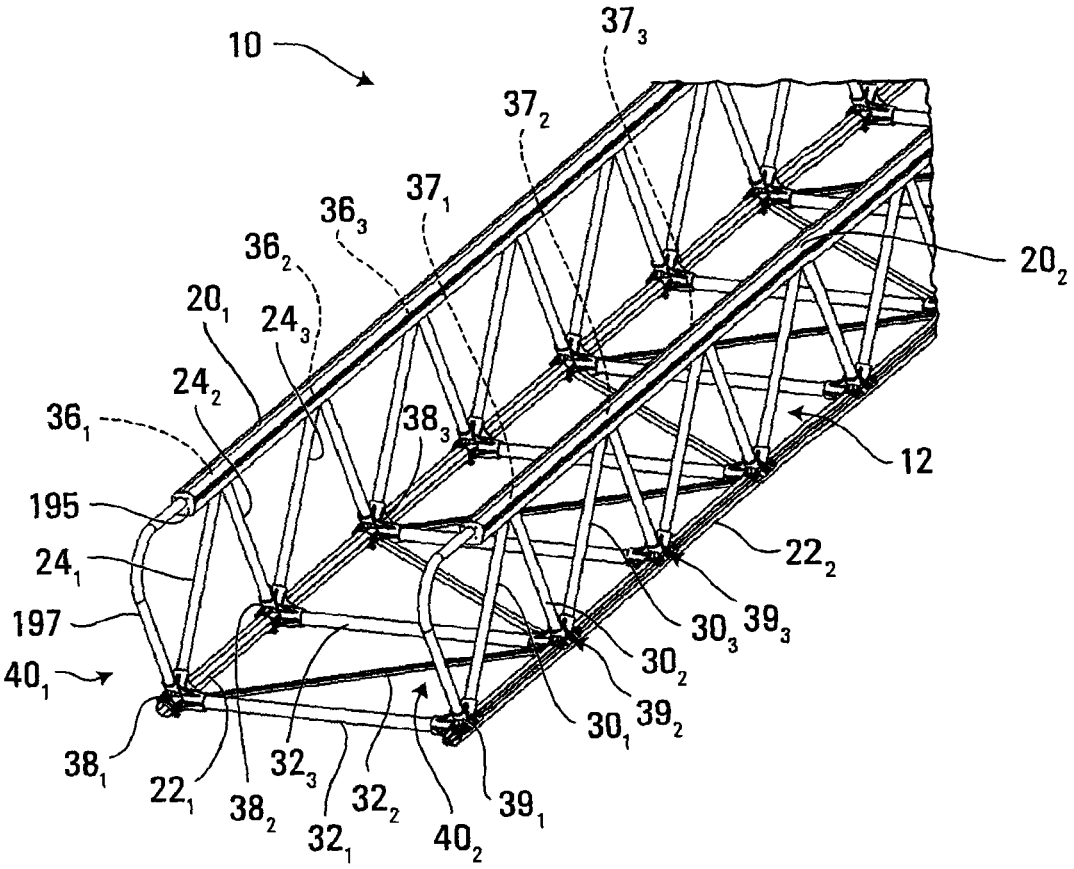
FIG. 1 shows a perspective view of a bridge comprising a structural assembly in accordance with an embodiment of the invention.
Figure 2:
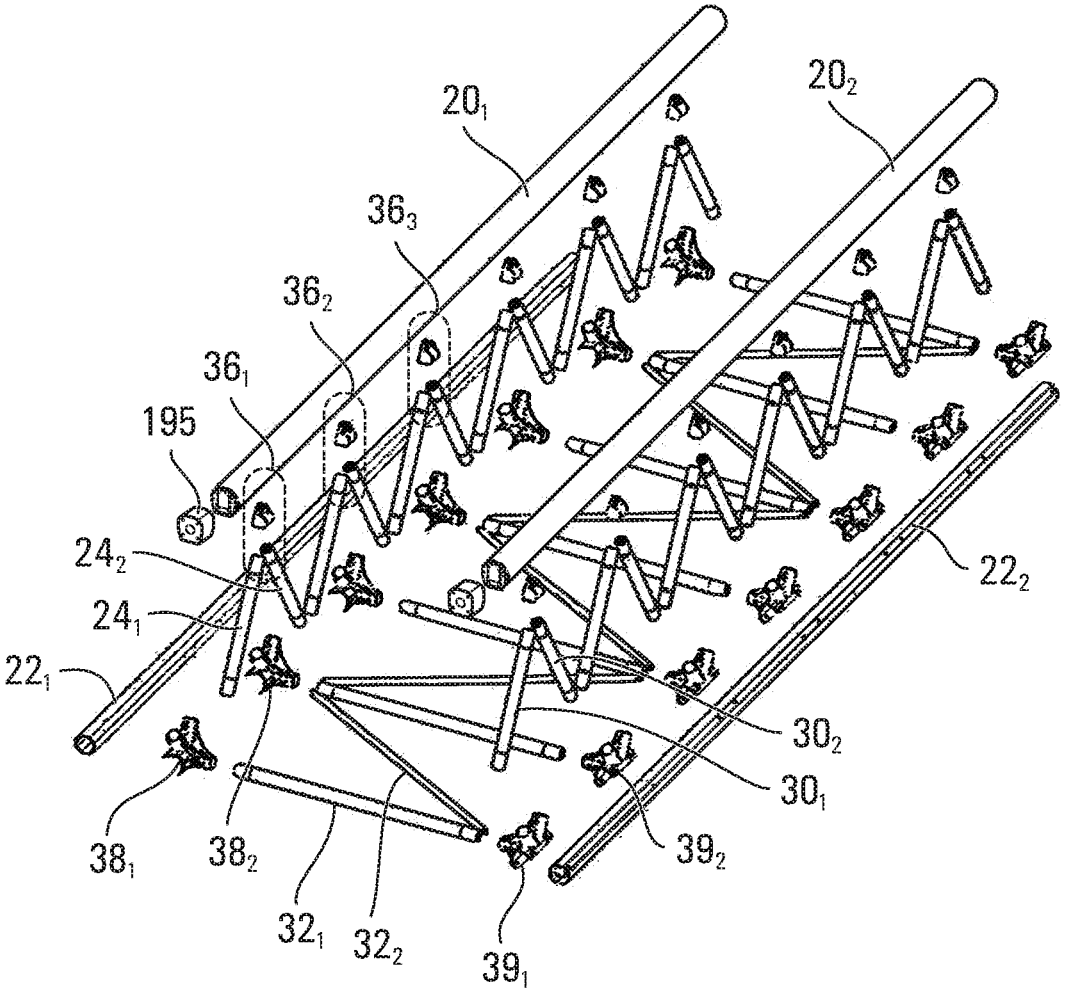
FIG. 2 shows an exploded view of the structural assembly.
Figure 3:
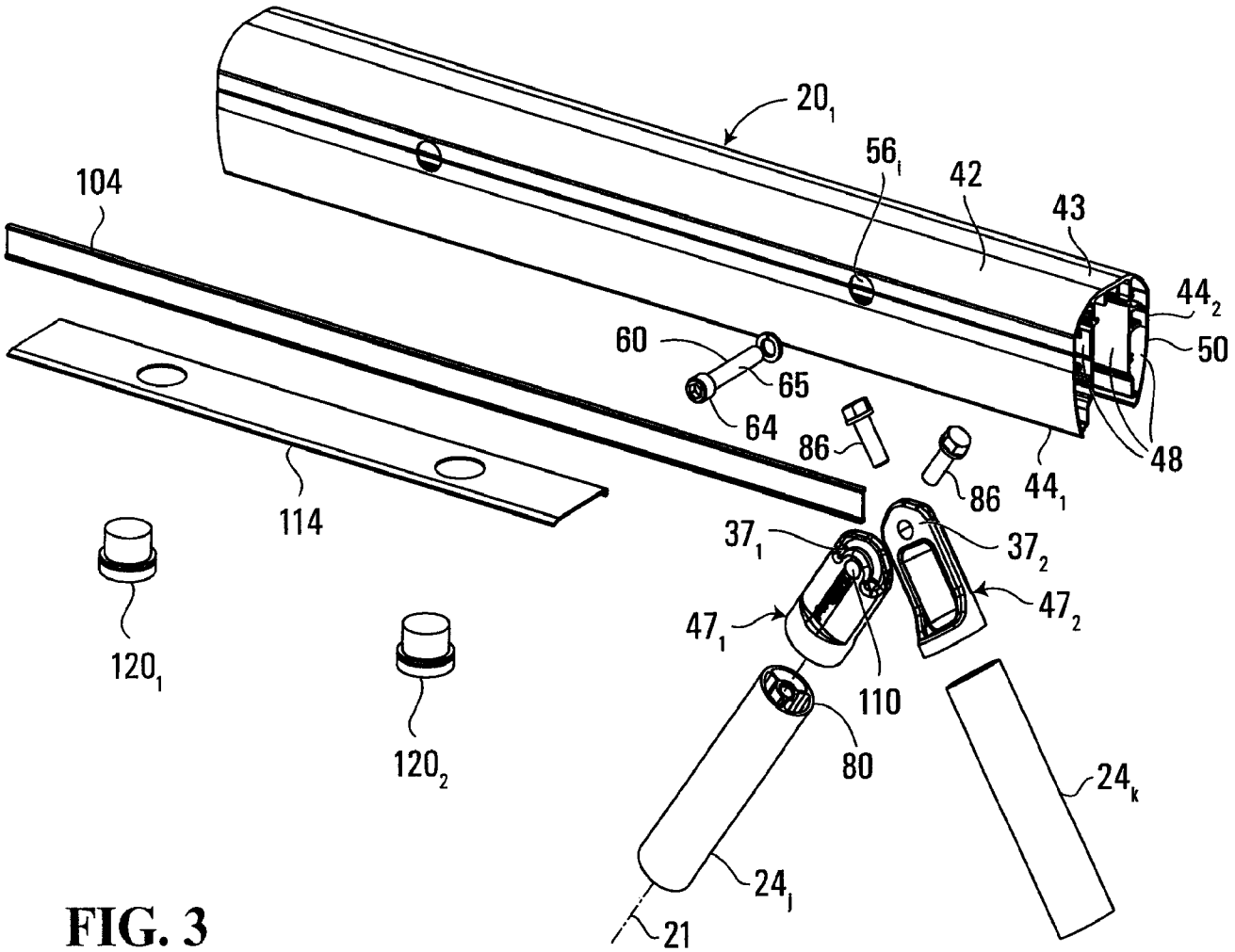
FIG. 3 shows an upper chord and a pair of web members interconnected at a pin connection node of the structural assembly.
Figure 4:
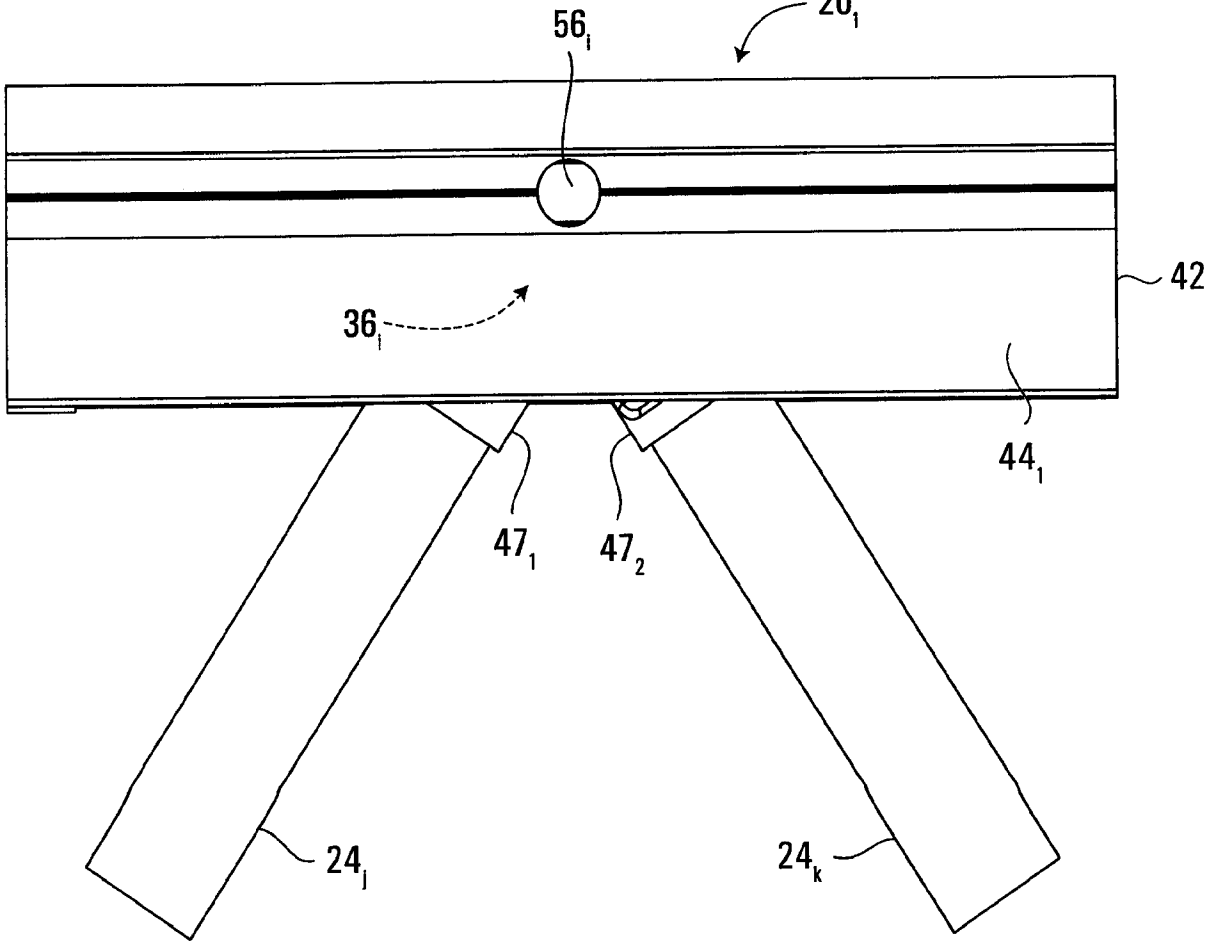
FIG. 4 shows a side elevation view of the upper chord and the web members.
Figure 5:
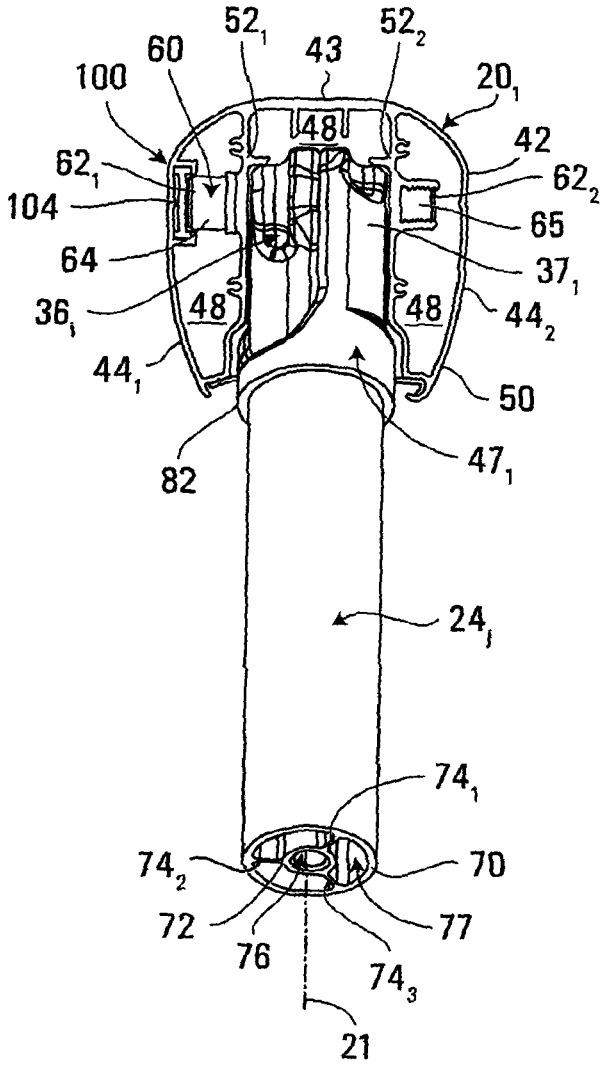
FIG. 5 shows a transversal elevation view of the upper chord and the web members.
Figure 6:
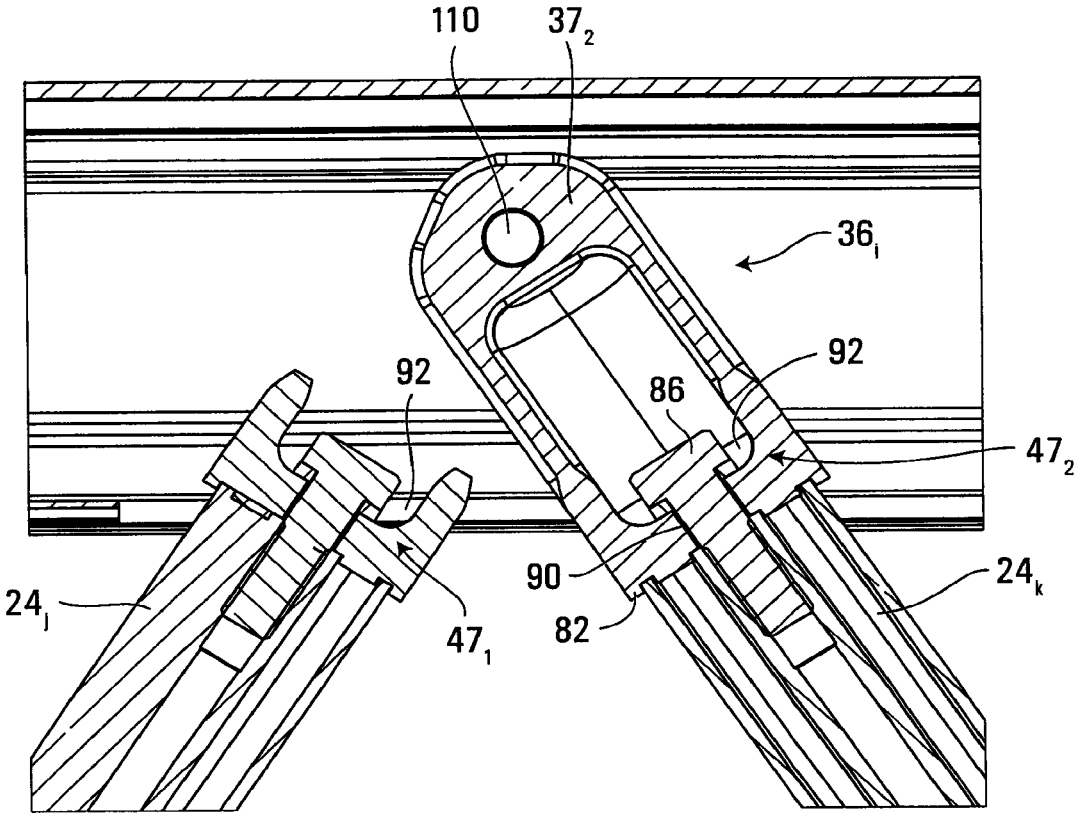
FIG. 6 shows a cross-sectional elevation view of the upper chord and the web members.
Figure 7:
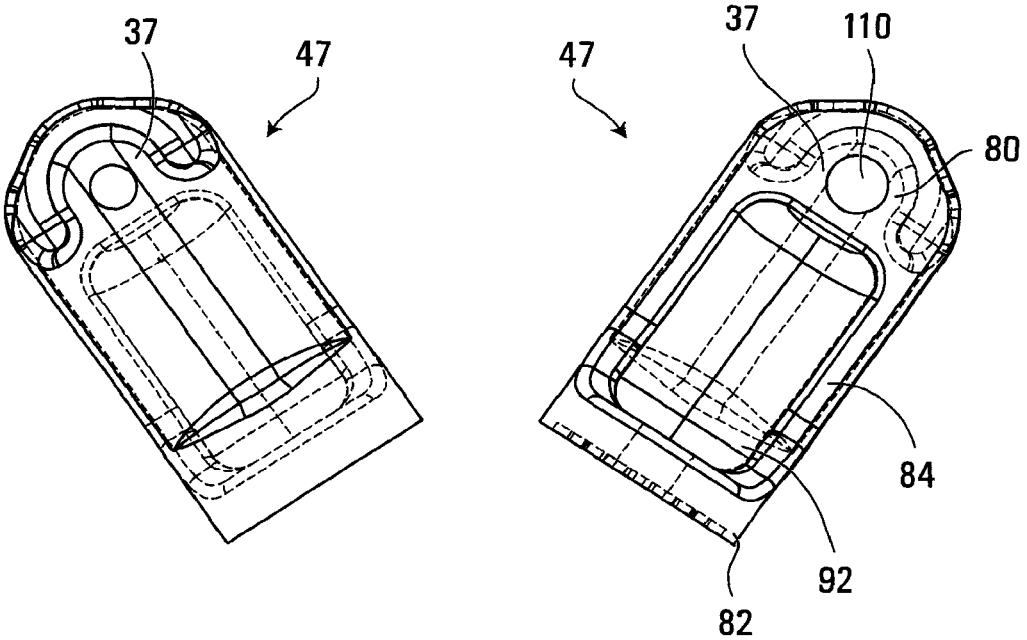
FIG. 7 shows a connector for the pin connection node.
Figure 8:
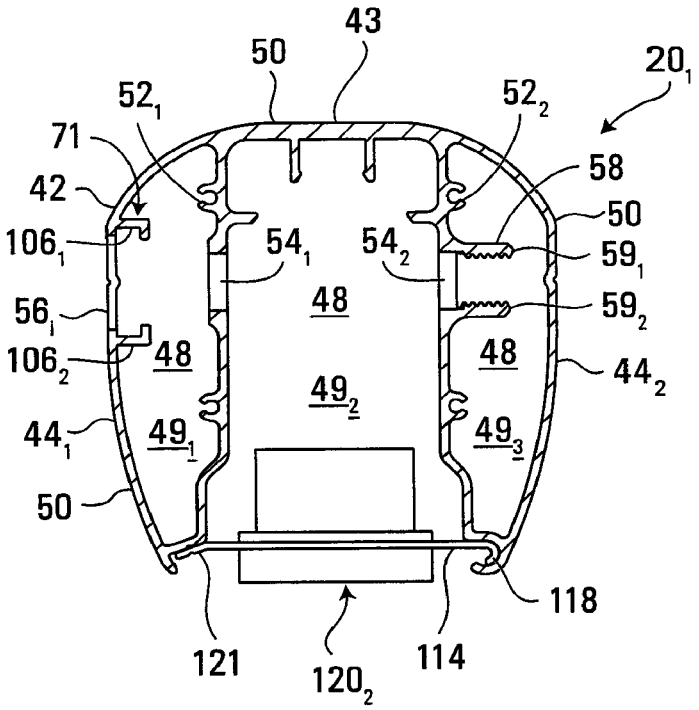
FIG. 8 shows a transversal cross-sectional view of the upper chord.
Figure 9:
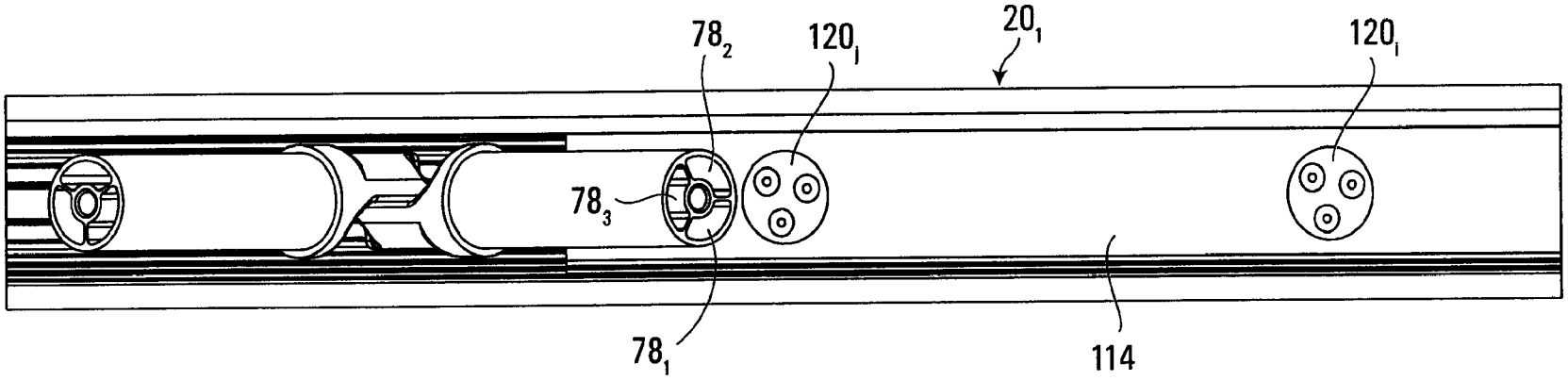
FIG. 9 shows a bottom view of the upper chord and the web members.

FIGS. 1 and 2 show a bridge 10 comprising a structural assembly 12 in accordance with an embodiment of the invention. In this example, the bridge 10 is a pedestrian bridge (i.e., a footbridge) providing a pathway that can be used for various purposes. For instance, the bridge 10 may be part of: a crossing to go over a depression or obstacle on the ground, a stream or body of water, or another outdoor area; a crossing to move over a room or other space in a building; an overpass above a highway or other road; a skywalk connecting two buildings; a gangway for boarding a ship, an airplane, a train or another vehicle; or any other structure bridging two or more areas.

The structural assembly 12 comprises an assembly of structural members forming a framework of the bridge 10. More particularly, in this embodiment, the structural assembly 12 comprises: a pair of upper elongated members $\mathbf{20}_1$, $\mathbf{20}_2$, a pair of lower elongated members $\mathbf{22}_1$, $\mathbf{22}_2$, and a plurality of framing members $\mathbf{24}_1$-$\mathbf{24}_N$, $\mathbf{30}_1$-$\mathbf{30}_N$, $\mathbf{32}_1$-$\mathbf{32}_M$ each extending between two of these upper and lower elongated members. The elongated members $\mathbf{20}_1$, $\mathbf{20}_2$, $\mathbf{22}_1$, $\mathbf{22}_2$ and the framing members $\mathbf{24}_1$-$\mathbf{24}_N$, $\mathbf{30}_1$-$\mathbf{30}_N$, $\mathbf{32}_1$-$\mathbf{32}_M$ are connected to one another at a plurality of nodes, including a plurality of upper nodes $\mathbf{36}_1$-$\mathbf{36}_P$, $\mathbf{37}_1$-$\mathbf{37}_P$ and a plurality of lower nodes $\mathbf{38}_1$-$\mathbf{38}_R$, $\mathbf{39}_1$-$\mathbf{39}_R$.

More particularly, in this embodiment, the bridge 10 is a truss bridge, in this case, a pony-truss bridge (also known as a "half-through" truss bridge), and the structural assembly 12 is a truss assembly in which the upper elongated members $\mathbf{20}_1$, $\mathbf{20}_2$ are upper chords, the lower elongated members $\mathbf{22}_1$, $\mathbf{22}_2$ are lower chords, and the framing members $\mathbf{24}_1$-$\mathbf{24}_N$, $\mathbf{30}_1$-$\mathbf{30}_N$, $\mathbf{32}_1$-$\mathbf{32}_M$ are web members. The structural assembly 12 can thus be viewed as comprising a first vertical truss $\mathbf{40}_1$, which comprises the upper chord $\mathbf{20}_1$, the lower chord $\mathbf{22}_1$, and the web members $\mathbf{24}_1$-$\mathbf{24}_N$, and a second vertical truss $\mathbf{40}_2$, which comprises the upper chord $\mathbf{20}_2$, the lower chord $\mathbf{22}_2$, and the web members $\mathbf{30}_1$-$\mathbf{30}_N$. The framing members $\mathbf{32}_1$-$\mathbf{32}_M$ interconnect the vertical trusses $\mathbf{40}_1$, $\mathbf{40}_2$ and support a floor (not shown) of the bridge 10 (e.g., stringers, decking, etc.). The bridge 10 may also comprise fencing (not shown) mounted to the vertical trusses $\mathbf{40}_1$, $\mathbf{40}_2$.

With additional reference to FIGS. 3 to 9, the vertical truss $\mathbf{40}_1$ will be described in further detail with an understanding that, in this embodiment, the vertical truss $\mathbf{40}_2$ is configured in a similar manner.

The upper chord $\mathbf{20}_1$ can be made in various ways. In this embodiment, the upper chord $\mathbf{20}_1$ is an extruded metallic member. Specifically, in this example, the upper chord $\mathbf{20}_1$ is an extruded aluminum member. This may facilitate manufacturing of the upper chord $\mathbf{20}_1$ and help to minimize its weight and consequently that of the bridge 10. The upper chord $\mathbf{20}_1$ may be made using various other processes and/or other materials in other embodiments. For example, in some embodiments, the upper chord $\mathbf{20}_1$ may comprise a plurality of parts affixed to one another (e.g., by welding, fastening, interlocking, etc.) and/or may be made of other metallic materials (e.g., steel) or other materials (e.g., polymer, composite).

The upper chord $\mathbf{20}_1$ has a periphery 42. In this embodiment, the periphery 42 comprises a top surface 43 and a pair of lateral surfaces $\mathbf{44}_1$, $\mathbf{44}_2$ opposite one another. In this case, the top surface 43 is generally flat and the lateral surfaces $\mathbf{44}_1$, $\mathbf{44}_2$ are curved. The periphery 42 may be shaped in various other ways in other embodiments. For example, in other embodiments, the top surface 43 and/or the lateral surfaces $\mathbf{44}_1$, $\mathbf{44}_2$ may be shaped differently and/or oriented differently, and/or the periphery 42 may comprise one or more other surfaces (e.g., a bottom surface).

The upper chord $\mathbf{20}_1$ defines an internal space 48. The internal space 48 is within and delimited by the periphery 42 of the upper chord $\mathbf{20}_1$. More particularly, in this embodiment, the upper chord $\mathbf{20}_1$ comprises an outer wall 50 defining the periphery 42 and delimiting the internal space 48. Also, in this embodiment, the upper chord $\mathbf{20}_1$ comprises a plurality of inner walls $\mathbf{52}_1$, $\mathbf{52}_2$ which partition the internal space 48 into a plurality of portions, including a first portion $49_1$, a second portion $49_2$ and a third portion $49_3$. In this case, each of the inner walls $52_1$, $52_2$ merges with the outer wall 50 at two points such that each of the first portion $49_1$ and the third portion $49_3$ of the internal space 48 is a closed portion of the internal space 48. In contrast, the second portion $49_2$ of the internal space 48 is open at a bottom of the upper chord $20_1$. In other cases, each of the inner walls $52_1$, $52_2$ may merge with the outer wall 50 at a single point (e.g., near the top surface 43) or at more than two points. The internal space 48 may be configured in various other ways in other embodiments. For example, in some embodiments, the outer wall 50 may be thicker and/or have a varying thickness, and/or the inner walls $52_1$, $52_2$ may have various other shapes and/or thicknesses or may be omitted.

As further discussed below, in this embodiment, the upper nodes $36_1$-$36_P$ are located in the internal space 48. The upper chord $20_1$ is configured to facilitate connection of the web members $24_1$-$24_N$ to itself at the upper nodes $36_1$-$36_P$, while preventing tampering with these nodes. To that end, in this embodiment, the upper chord $20_1$ comprises a plurality of openings $56_1$-$56_P$, $54_1$, $54_2$, an inner pin-retaining portion 58, and a barrier-supporting portion 71, whose purposes are discussed later on.

The web members $24_1$-$24_N$ can be made in various ways. In this embodiment, the web members $24_1$-$24_N$ are extruded metallic members. Specifically, in this example, the web members $24_1$-$24_N$ are extruded aluminum members. This may facilitate manufacturing of the web members $24_1$-$24_N$ and help to minimize their weight and consequently that of the bridge 10. The web members $24_1$-$24_N$ may be made using various other processes and/or other materials in other embodiments. For example, in some embodiments, each of the web members $24_1$-$24_N$ may comprise a plurality of parts affixed to one another (e.g., by welding, fastening, interlocking, etc.) and/or may be made of other metallic materials (e.g., steel) or other materials (e.g., polymers, composite).

Figure 16:
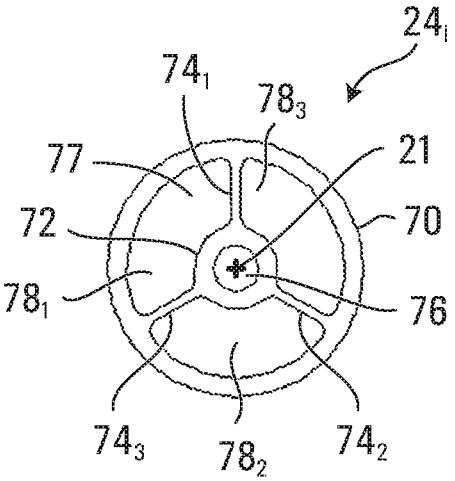
FIG. 16 shows a cross-sectional view of one of the web members.

With additional reference to FIG. 16, in this embodiment, each web member $24_i$ of the web members $24_1$-$24_N$ is a tubular member having an outer wall 70 delimiting an internal space 77. The web member $24_i$ also comprises a plurality of inner walls, including an inner tubular wall 72 running generally parallel to the outer wall 70 and connected to the outer wall 70 by three inner walls $74_1$-$74_3$ extending generally radially. In this case, the outer wall 70, inner tubular wall 72 and inner walls $74_1$-$74_3$, all have the same length. In other cases, any one of these walls may extend pass or stop short of any extremity of any other one of these walls. The inner tubular wall 72 and the inner walls $74_1$-74 partition of the internal space 77 into a first portion $78_1$, a second portion $78_2$ and a third portion $78_3$. An interior elongated channel 76 is defined by the inner tubular wall 72. As further discussed below, the interior elongated channel 76 may be adapted to receive a fastener. Each web member 24; is thus mainly hollow and relatively lightweight, while providing sufficient strength.

Each web member $24_i$ may be configured in various other ways in other embodiments. For example, in other embodiments, the outer wall 70 may have a shape other than circular (e.g., polygonal). As another example, in other embodiments, any one of the inner tubular wall 72 and the inner walls $74_1$-$74_3$ may be shaped differently or omitted, or the web member $24_i$ may comprise more or less inner walls such as the inner walls $74_1$-$74_3$. As yet another example, in other embodiments, the web member $24_i$ may be full instead of hollow.

Each of the upper nodes $36_1$-$36_P$ is a pin connection node, i.e., a node constituting a pin connection. A pin connection is designed to transfer axial and shear forces but not moments. In other words, in two dimensions, a pin connection restrains two translational degrees of freedom but does not restrain a rotational degree of freedom.

Each upper node $36_i$ interconnects a first web member $24_j$ of the web members $24_1$-$24_N$, a second web member $24_k$ of the web members $24_1$-$24_N$, and the upper chord $20_1$. Thus, the web member $24_j$, the web member $24_k$, and the upper chord $20_1$ are interconnected via a pin connection.

The upper node $36_i$ comprises a first connecting portion $37_1$ for connecting the web member $24_j$ and a second connecting portion $37_2$ for connecting the web member $24_k$. In this embodiment, the first connecting portion $37_1$ is part of a first connector $47_1$ which is separate from and mounted to the web member $24_j$. Similarly, the second connecting portion $37_2$ is part of a second connector $47_2$ separate from and mounted to the web member $24_k$. In other embodiments, the first connecting portion $37_1$ may be integral with the web member $24_j$ and/or the second connecting portion $37_2$ may be integral with the web member $24_k$.

The upper node $36_i$ also comprises a pin 60 interconnecting the web member $24_j$, the web member $24_k$, and the upper chord $20_1$. The pin 60 comprises an elongated object having a first longitudinal end $62_1$ and a second longitudinal end $62_2$ and suitable for interconnecting the web member $24_j$, the web member $24_k$, and the upper chord $20_1$ in a pin connection. For example, in various embodiments, the pin 60 may comprise a rod, a shaft, a key, a fastener (e.g., a bolt or stud with a nut, a screw, etc.), or any other hardware capable of being used to interconnect the web member $24_j$, the web member $24_k$, and the upper chord $20_1$ in a manner which permits a degree of rotational movement of one of these structural members relative to another one of these structural members. In this embodiment, the pin 60 comprises a generally cylindrical part. The pin 60 may be configured in various other ways in other embodiments (e.g., the pin 60 may comprise a part having a noncircular periphery).

In this embodiment, the pin 60 also serves to fasten the web member $24_j$, the web member $24_k$, and the upper chord $20_1$. To that end, the pin 60 comprises a fastener. For instance, the fastener may be a threaded fastener (e.g., a bolt or stud with a nut, a screw, etc.), a rivet, a clamp, or any device or group of devices capable of fastening the web member $24_j$, the web member $24_k$, and the upper chord $20_1$. More specifically, in this embodiment, the pin 60 comprises a bolt.

The connectors $47_1$, $47_2$ may be configured in various ways. In this embodiment, the connectors $47_1$, $47_2$ are made of metal, in this case, aluminum, cast into shape. The connectors $47_1$, $47_2$ may be made of other metallic material (e.g., steel) or other materials (e.g., polymer, composite) and/or using other manufacturing processes (e.g., milled or otherwise machined) in other embodiments. Also, in this embodiment, the connectors $47_1$, $47_2$ are substantially identical, such that only one type of connector needs to be produced for both the web members $24_i$, $24_k$. In other embodiments, the connectors $47_1$, $47_2$ may be different from one another.

The connector $47_1$ will be discussed further with an understanding that a similar discussion applies to the connector $47_2$.

In this case, the connector $47_1$ is mounted to an upper extremity of the web member $24_j$. The connector $47_1$ is dimensioned so as to cover an upper extremity surface 80 of the web member $24_j$. Here, the connector $47_1$ comprises a circular base portion 82 for abutting the upper extremity surface 80. The connector $\mathbf{47}_1$ may be located elsewhere along the length of the web member $\mathbf{24}_i$ in other cases.

The connector $\mathbf{47}_1$ comprises an upper portion 84 projecting from the base portion 82. In this example, the upper portion 84 is tapered and off-center relative to a central longitudinal axis 21 of the web member $\mathbf{24}_i$. As such, the web members $\mathbf{24}_i$ and $\mathbf{24}_k$ can be crossed at the location of their connectors $\mathbf{47}_1$ and $\mathbf{47}_2$ such that their central longitudinal axes 21 intersect. In other embodiments, the central longitudinal axes 21 of the web members $\mathbf{24}_i$ and $\mathbf{24}_k$ may not intersect.

The upper portion 84 of the connector $\mathbf{47}_1$ comprises a contact surface 88 for contacting a corresponding contact surface 88 of the connector $\mathbf{47}_2$. In this example, the contact surface 88 is generally flat to facilitate sliding over the corresponding contact surface 88 of the connector $\mathbf{47}_2$. In other examples, the contact surface 88 may have a different profile (e.g., curved, jagged, etc.). In yet other examples, there may be no contact surface 88 on the upper portion 84, such as in cases where the connectors $\mathbf{47}_1$, $\mathbf{47}_2$ do not contact one another at the pin connection node $\mathbf{46}_i$. Indeed, in some embodiments, the connectors $\mathbf{47}_1$, $\mathbf{47}_2$ may be spaced apart and possibly separated by an intermediate component.

The connector $\mathbf{47}_1$ comprises a through-hole 110 to receive the pin 60. When the connector $\mathbf{47}_1$ is mounted to the web member $\mathbf{24}_i$, the through-hole 110 extends in a direction transverse to the central longitudinal axis 21 of the web member $\mathbf{24}_i$. In this case, the through-hole 110 extends inwardly from the contact surface 88 such that the contact surface 88 adjacent the through-hole 110 acts as a bearing surface.

The connector $\mathbf{47}_1$ may be mounted to the web member $\mathbf{24}_i$ in various ways. In this embodiment, the connector $\mathbf{47}_1$ is mounted to the web member $\mathbf{24}_i$ via a fastener 86. In this example, the fastener 86 is a threaded fastener, and more specifically a bolt. An aperture 90 provides a passage through the circular base 82 for receiving the fastener 86. The fastener 86 holds the connector $\mathbf{47}_1$ to the web member $\mathbf{24}_i$ by engaging the inner tubular wall 72 defining the inner elongated channel 76 to screw tightly therein. For instance, the inner elongated channel 76 may comprise internal threading to engage threads of the fastener 86. A recess 92 is provided in the upper portion 84 to accommodate, and provide access to, a head of the bolt.

In this embodiment, the fastener 86 extends along a neutral axis of the web member $\mathbf{24}_i$, which in this case corresponds to the central longitudinal axis 21. In embodiments, the fastener 86 may extend along a different longitudinal axis of the web member $\mathbf{24}_i$. For example, in some embodiments, the fastener 86 may extend along an axis parallel to the neutral axis of the web member $\mathbf{24}_i$. The fastener 86 may be oriented or otherwise arranged in various other ways to fasten the connector $\mathbf{47}_1$ to the web member $\mathbf{24}_i$ in other embodiments.

When assembled, the upper node $\mathbf{36}_i$ interconnects the web member $\mathbf{24}_j$, the web member $\mathbf{24}_k$, and the upper chord $\mathbf{20}_1$. Specifically, the opening $\mathbf{56}_i$ in the outer wall 50 of the upper chord $\mathbf{20}_1$ and the openings $\mathbf{54}_1$, $\mathbf{54}_2$ in the inner walls $\mathbf{52}_1$, $\mathbf{52}_2$ of the upper chord are coaxial such that the pin 60 can be inserted through the opening $\mathbf{56}_i$ and extend through the openings $\mathbf{54}_1$, $\mathbf{54}_2$ and the through-holes 110 of the connectors $\mathbf{47}_1$, $\mathbf{47}_2$ mounted to the web members $\mathbf{24}_i$, $\mathbf{24}_k$. This allows a degree of rotation of the upper chord $\mathbf{20}_1$, the web member $\mathbf{24}_i$ and the web member $\mathbf{24}_k$ relative to one another about the longitudinal axis of the pin 60.

Also, in this embodiment, the pin 60 is held in place and fastens together the web member $\mathbf{24}_j$, the web member $\mathbf{24}_k$, and the upper chord $\mathbf{20}_1$. Specifically, in this embodiment, the pin 60 comprises a bolt which comprises a tool-engaging head 64 and a shank 65 with threads. The bolt is held in place and fastens together the web member $\mathbf{24}_j$, the web member $\mathbf{24}_k$, and the upper chord $\mathbf{20}_1$ by having the tool-engaging head 64 abut against the inner wall $\mathbf{51}_1$ of the upper chord $\mathbf{20}_1$ and the threads of the shank 65 engaged in the inner pin-retaining portion 58 of the upper chord $\mathbf{20}_1$.

More particularly, in this example, the inner pin-retaining portion 58 is a thread-engaging portion which comprises a pair of ridged surfaces $\mathbf{59}_1$, $\mathbf{59}_2$ having facing each other for engaging the threads on the bolt 60. Thus, the bolt 60 can be screwed into place in the upper chord $\mathbf{20}_1$. In this case, the ridged walls $\mathbf{59}_1$ and $\mathbf{59}_2$ are straight and run the entire length of the upper chord $\mathbf{20}_1$ so that they can be formed during the upper chord's extrusion process. The inner pin-retaining portion 58 may be configured in various other ways in other embodiments. For instance, in some embodiments, the inner pin-retaining portion 58 may comprise a built-in nut-like structure.

In this embodiment, the upper node $\mathbf{36}_i$ is concealed from view and inaccessible to an observer on the bridge 10. This may improve overall esthetics of the bridge 10 and discourage potential vandals from attempting to tamper with the upper node $\mathbf{36}_i$.

More particularly, in this embodiment, the first longitudinal end $\mathbf{62}_1$ and the second longitudinal end $\mathbf{62}_2$ of the pin 60 are located in the internal space 48 of the upper chord $\mathbf{20}_1$. This positioning of the first and second longitudinal ends $\mathbf{62}_1$ and $\mathbf{62}_2$ of the pin 60 in the internal space 48 creates a natural concealment of the pin 60. In other embodiments, only one of the longitudinal ends $\mathbf{62}_1$, $\mathbf{62}_2$ of the pin 60 may be located in the internal space 48, while the other one may be located outside of the internal space 48.

The first longitudinal end $\mathbf{62}_1$ and the second longitudinal end $\mathbf{62}_2$ of the pin 60 are thus located within the periphery 42 of the upper chord $\mathbf{20}_1$. That is, each of the longitudinal ends $\mathbf{62}_1$, $\mathbf{62}_2$ of the pin 60 does not extend beyond the periphery 42 of the upper chord $\mathbf{20}_1$. Specifically, in this embodiment, each of the longitudinal ends $\mathbf{62}_1$, $\mathbf{62}_3$ of the pin 60 is located between the lateral surfaces $\mathbf{44}_1$, $\mathbf{44}_2$ of the upper chord $\mathbf{20}_1$.

The opening $\mathbf{56}_i$ in the outer wall 50 of the upper chord $\mathbf{20}_1$ and the openings $\mathbf{54}_1$, $\mathbf{54}_2$ in the inner walls $\mathbf{52}_1$, $\mathbf{52}_2$ of the upper chord $\mathbf{20}_1$ allow the pin 60 to be inserted from a single side of the upper chord $\mathbf{20}_1$, such that no opening is required in the outer wall 50 on the opposite side of the opening $\mathbf{56}_i$. Thus, in this embodiment, the outer wall 50 is free of (i.e., lacks) openings extending inwardly from the lateral surface $\mathbf{44}_2$ and aligned with the openings $\mathbf{56}_1$-$\mathbf{56}_P$. As such, when the pin 60 is inserted, the second longitudinal end $\mathbf{62}_2$ of the pin 60 is within the internal space 48 (in this case, within the third portion $\mathbf{49}_3$ of the internal space 48) and concealed from view to an observer on the bridge 10. Because there is no need to have openings extending inwardly from the lateral surface $\mathbf{44}_2$ of the upper chord $\mathbf{20}_1$, in this embodiment, the lateral surface $\mathbf{44}_2$, which faces the pathway of the bridge 10 and is thus viewed by observers on the bridge 10, is a flush continuous surface.

The pin 60 is inserted deep enough into the upper chord $\mathbf{20}_1$ that its first longitudinal end $\mathbf{62}_1$ is in the internal space 48 of the upper chord $\mathbf{20}_1$. In this case, the first longitudinal end $\mathbf{62}_1$ of the pin is in the first portion $\mathbf{49}_1$ of the internal space 48 of the upper chord $\mathbf{20}_1$. Although the first longitudinal end $\mathbf{62}_1$ of the pin 60 is located in the internal space 48 of the upper chord $\mathbf{20}_1$, a plug (not shown) may be inserted into the opening $\mathbf{56}_i$ so as to block the opening $\mathbf{56}_i$ and conceal the first longitudinal end $62_1$ of the pin 60 from an observer. Such plugs in the openings $56_1$-$56_p$ may also improve the overall esthetics of the bridge 10 when viewed from the side of the openings $56_1$-$56_p$.

While plugs can be useful, they can sometimes be removed with a tool such as a screw driver. Therefore, while plugging the opening $56_i$ with a plug may block the view of the pin 60, it may not necessarily greatly reduce the possibility of tampering with the pin 60. In particular, in some cases, it may be desirable to render the pin 60 inaccessible, for example, to preclude vandals from tampering with the pin 60.

To that end, in this embodiment, a tamperproof arrangement 100 is provided to prevent access to the pin 60. More particularly, in this embodiment, the tamperproof arrangement 100 comprise a barrier 104 supported by the aforementioned barrier-supporting portion 71 of the upper chord $20_1$. The barrier 104 is placed in front of the first longitudinal end $62_1$ of the pin 60 and blocks access to the pin 60 through the opening $56_i$.

In this example, the barrier-supporting portion 71 comprises upper and lower projections $106_1$, $106_2$ that run the entire length of the upper chord $20_1$ such that the barrier-supporting portion 71 can be formed during the chord's extrusion process. The barrier 104 comprises a blocking panel which can be slidably received in the barrier-supporting portion 71 from a longitudinal extremity of the upper chord $20_1$. In this case, this blocking panel extends the entire length of the upper chord $20_1$. In other cases, the barrier 104 may be discontinuous and present only in the vicinity of the openings $56_1$-$56_p$.

Although the brace 102 is shown here as extending inwards from the outer wall 50, it should be understood that the brace 102 may be formed in one or more other walls. For example the brace 102 may consist of projections extending from the inner wall $52_1$.

The tamperproof arrangement 100 may be configured in various other ways in other embodiments. For example, in other embodiments, the barrier-engaging portion 71 may be shaped differently and/or may be formed in one or more other walls of the upper chord $20_1$ (e.g., the inner wall $52_1$). Also, in other embodiments, the barrier 104 may comprise any other suitable component for preventing access to the pin 60. For example, the barrier 104 may comprise one or more tamper-proof plugs that may be used instead of regular plugs to block opening $56_1$-$56_p$. Such tamper-proof plugs may snap-in permanently, be glued, or be affixed by non-removable fasteners.

Also, while in this embodiment the tamperproof arrangement 100 is provided only on the side of the upper chord $20_1$ which has the opening $56_i$ since only the opening $56_i$ allows access to the pin 60 (as the second longitudinal end $62_2$ of the pin 60 is inaccessible by virtue of being located in the interior space 48 and overlaid by the lateral surface $44_2$ of the outer wall 50), in other embodiments, the tamperproof arrangement 100 may comprise one or more other components anywhere where access is to be blocked. For example, in embodiments where an opening is provided in the upper chord $20_1$ on the opposite side of the opening $56_1$ (giving access to the second longitudinal end $62_2$ of the pin 60), the tamperproof arrangement 100 may comprise a barrier and barrier-supporting portion, similar to the barrier 104 and the barrier-supporting portion 71, on that opposite side of the upper chord $20_1$ as well.

The web members $24_i$, $24_k$ protrude from a bottom region of the upper chord $20_1$. As such, in this embodiment, the internal space 48 is open at the bottom region of the upper chord $20_1$ to allow passage of the web members $24_i$, $24_k$. However, in this embodiment, in areas of the upper chord $20_1$ between the upper nodes $36_1$-$36_p$, the bottom region of the upper chord $20_1$ is closed.

More particularly, in this embodiment, a barrier 114 is mounted to the upper chord $20_1$ to close the bottom region of the upper chord $20_1$ in the areas between the upper nodes $36_1$-$36_p$. The barrier 114 may comprise any suitable structure openable (e.g., hinged), removable or permanently affixed to the upper chord $20_1$ to close its bottom region in the areas between the upper nodes $36_1$-$36_p$. In this example, the barrier 114 comprises a door hingedly connected to the upper chord $20_1$ (in this case, to the inner wall $52_1$ of the upper chord $20_1$) so that it can be "swung" open. In this case, the door is hingedly connected via a live hinge 121. In other cases, the door may be hinged by any other hinging means (e.g., a pivot hinge). In this example, the door also comprises a retaining portion 118 to keep it in its closed position. In this case, the retaining portion 118 is a snap-fit portion which fits in a corresponding recess formed by the outer wall 50 of the upper chord $20_1$. In other embodiments, the barrier 114 may be removable (e.g. by having snap-fit arrangements on both transverse sides or by any other means) or may be permanently affixed to the bottom region of the upper chord $20_1$ (e.g. by being permanently snap-fit into place, by being glued, or by being welded in place). The barrier 114 may also be slid into place from a longitudinal end of the upper chord $20_1$ during assembly.

In this embodiment, the structural assembly 12 comprises a support 89 for supporting an illumination system 112 for emitting light from the upper chord $20_1$. The illumination system 112 comprises one or more lighting devices to emit light, which can be used on the bridge 10 for functional and/or aesthetic reasons. In this embodiment, the support 89 is implemented by the barrier 14 in the bottom region of the upper chord $20_1$. The support 89 may be implemented in various other ways in other embodiments (e.g., by the outer wall 50, one or more of the inner walls $52_1$, $52_2$, and/or another portion of the upper chord $20_1$).

More particularly, in this embodiment, the illumination system 112 comprises a plurality of lighting devices $120_1$-$120_L$ distributed along the upper chord $20_1$. At least part of each of the lighting devices $120_1$-$120_L$ is located in the internal space 48 of the upper chord $20_1$. This helps to protect the lighting devices $120_1$-$120_L$. In this example, the lighting devices $120_1$-$120_L$ are mounted to the barrier 114 in the bottom region of the upper chord $20_1$ for illuminating an area beneath the upper chord $20_1$. In other examples, the lighting devices $120_1$-$120_L$ may be mounted elsewhere on the upper chord $20_1$ for illuminating one or more other areas adjacent to (e.g., adjacent, on lateral sides, etc.) the upper chord $20_1$.

Each of the lighting devices $120_1$-$120_L$ may take on various forms. In this embodiment, the lighting devices $120_1$-$120_L$ are light-emitting diode (LED) lighting devices. More specifically, in this case, each of the LED lighting devices $120_1$-$120_L$ comprise three different LED light sources, each generating light of a different color. In other cases, each of the LED lighting devices $120_1$-$120_L$ may emit monochromatic light only. The lighting devices $120_1$-$120_L$ may take on other forms (e.g., light bulbs) in other embodiments.

Illumination may be controlled by any suitable means (e.g., for turning the lights on and off, and/or for providing light of different colors). In this example, wires (not shown) connected to the lighting devices $120_1$-$120_L$ for powering and/or controlling the lighting devices $120_1$-$120_L$ run inside the internal space 48 of the upper chord $\mathbf{20}_1$. This protects the wires and connections to the lighting devices $\mathbf{120}_1$-$\mathbf{120}_L$ from weather elements and avoids the esthetical unpleasantness of exposed wires.

As described above, in this embodiment, the upper chord $\mathbf{20}_1$ has the barrier 104 inserted therein from a longitudinal end of the upper chord $\mathbf{20}_1$ as well as the barrier 114 slid into place from a longitudinal end of the upper chord $\mathbf{20}_1$. In order to increase the tamper-proofness of the bridge 10, in this embodiment, each of the longitudinal ends of the upper chord $\mathbf{20}_1$ is fitted with an end-piece 195, as shown in FIGS. 1 and 2. The end-piece 195 may be secured to the chord $\mathbf{20}_1$ by any suitable manner. For instance, in this case, the end-piece 195 is bolted thereto using a tamper-proof bolt that can be tightened but not loosened. In addition, in this example, a handrail 197 is mounted to the end-piece 195 and linked to the lower chord $\mathbf{22}_1$.

Turning now to the lower chord $\mathbf{22}_1$, in this embodiment, the web members $\mathbf{24}_1$-$\mathbf{24}_N$ and the lower chord $\mathbf{22}_1$ connect together at the lower nodes $\mathbf{38}_1$-$\mathbf{38}_R$ by way of respective lower node connectors $\mathbf{130}_1$-$\mathbf{130}_R$. The framing members $\mathbf{32}_1$-$\mathbf{32}_M$ are connected to the lower chord $\mathbf{22}_1$ via the lower node connectors $\mathbf{130}_1$-$\mathbf{130}_R$. In this case, the framing members $\mathbf{32}_1$-$\mathbf{32}_M$ include transverse members $\mathbf{134}_1$-$\mathbf{134}_S$ and floor diagonals $\mathbf{132}_1$-$\mathbf{132}_Q$.

Connections to the lower chord $\mathbf{22}_1$ will now be described with reference to FIGS. 11 to 15 and 17 to 20. In this example, at a lower node $\mathbf{38}_i$ of the lower nodes $\mathbf{38}_1$-$\mathbf{38}_R$, a lower node connector $\mathbf{130}_i$ of the lower node connectors $\mathbf{130}_1$-$\mathbf{130}_R$ interconnects a first web member $\mathbf{24}_k$ of the web members $\mathbf{24}_1$-$\mathbf{24}_N$, a second web member $\mathbf{24}_M$ of the web members $\mathbf{24}_1$-$\mathbf{24}_N$, a transverse member $\mathbf{134}_i$ of the transverse members $\mathbf{134}_1$-$\mathbf{134}_S$, and the lower chord $\mathbf{22}_1$. In this case, the lower node connector 130; also connects to first and second floor diagonals $\mathbf{132}_i$, $\mathbf{132}_j$ of the floor diagonals $\mathbf{132}_1$-$\mathbf{132}_g$.

In this embodiment, the lower node $\mathbf{38}_i$ is a moment-transferring connection node, i.e., a node constituting a moment-transferring connection, which is a connection designed to transfer axial and shear forces as wells moments. In other words, in two dimensions, a moment-transferring connection restrains two translational degrees of freedom and a rotational degree of freedom.

More particularly, the lower node connector $\mathbf{130}_i$ is able to transfer bending moments. In this example, the transverse member $\mathbf{134}_j$ comprises a first longitudinal end 138 that is inserted into a cavity $\mathbf{142}_1$ of the lower node connector $\mathbf{130}_i$. The web members $\mathbf{24}_k$, $\mathbf{24}_m$ comprise respective lower longitudinal ends $\mathbf{140}_k$, $\mathbf{140}_m$ that are inserted into respective cavities $\mathbf{142}_2$, $\mathbf{142}_3$ of the lower node connector $\mathbf{130}_i$. The web members $\mathbf{24}_k$, $\mathbf{24}_m$ and the transverse member $\mathbf{134}_j$ may have tapered end portions for inserting into the respective cavities $\mathbf{142}_2$, $\mathbf{142}_3$, $\mathbf{142}_1$. The tapered end portions of the web members $\mathbf{24}_k$, $\mathbf{24}_m$ and the transverse member $\mathbf{134}_j$ may be machined (e.g., milled, turned, swaged) or brought to this tapered shape by any other process.

The lower node connector $\mathbf{130}_i$ is connected to the lower chord $\mathbf{22}_1$. In this embodiment, the lower node connector $\mathbf{130}_i$ comprises a channel 144 for receiving the lower chord $\mathbf{22}_1$. In this case, the channel 144 is open to allow the lower node connector $\mathbf{130}_i$ to simply be placed over the lower chord $\mathbf{22}_1$ to embrace the lower chord $\mathbf{22}_1$ in the channel 144. In other cases, the channel 144 may be closed (that is, surrounded as in a tunnel or partially surrounded such that the lower chord $\mathbf{22}_1$ cannot escape the channel 144 except by sliding out of it), requiring the lower node connector $\mathbf{130}_i$ to be slid into place along the lower chord $\mathbf{22}_1$.

Any suitable fastener may be used for securing the lower node connector $\mathbf{130}_i$ and the lower chord $\mathbf{22}_1$ to one another. In this embodiment, a pair of threaded fasteners is used to this end. More specifically, the lower node connector $\mathbf{130}_i$ is fastened to the lower chord $\mathbf{22}_i$ by a pair of bolts 148 and nuts 149 through two like pairs of holes adapted to align the lower node connector $\mathbf{130}_i$ and the lower chord $\mathbf{22}_1$. Both of the floor diagonals $\mathbf{132}_i$, $\mathbf{132}_j$ attach to the lower node connector $\mathbf{130}_i$ with bolts 158 and nuts 159.

The web members $\mathbf{140}_k$, $\mathbf{140}_m$ and the transverse member $\mathbf{134}_j$ may be secured to the lower node connector $\mathbf{130}_i$ in various manners. In this embodiment, the lower node connector $\mathbf{130}_i$ is adapted to receive a fastener 152 for holding each of the web members $\mathbf{24}_k$, $\mathbf{24}_m$ and the transverse member $\mathbf{134}_j$ in place in their respective cavities $\mathbf{142}_2$, $\mathbf{142}_3$, $\mathbf{142}_1$. The lower node connector $\mathbf{130}_i$ comprises an aperture 150 through the bottom of each cavity $\mathbf{142}_2$, $\mathbf{142}_3$, $\mathbf{142}_1$ such that, for each cavity, the fastener 152 can extend between the channel 144 and the cavity. In this example, the fasteners 152 are bolts that screw into the interior elongated channel 76 of the web members $\mathbf{24}_k$, $\mathbf{24}_m$ in a manner similar to that described above in relation to the fastener 86.

In this case, the fasteners 152 each have a tool-engaging head 153 and recesses 151 are provided to accommodate the tool engaging heads 153 of fasteners 152. The recesses 151 may be dimensioned so as to allow a tool to engage a tool-engaging head 153 while within the recess 151. In such a way, before the lower chord $\mathbf{22}_1$ is inserted into the channel 144, the fasteners 152 can be inserted into apertures 150 through the channel 144 into the respective web members $\mathbf{24}_k$, $\mathbf{24}_m$ or transverse member $\mathbf{134}_j$ until the tool-engaging heads 153 are contained within respective recesses 151. In this way, the channel 144 is not blocked by the fasteners and the lower chord $\mathbf{22}_1$ is not impeded from being received therein. In addition to allowing unimpeded close contact between the lower chord $\mathbf{22}_1$ and the lower node connector $\mathbf{130}_1$, this arrangement has the added benefit that once the lower chord $\mathbf{22}_1$ is installed, the fasteners 152, and particularly their tool engaging heads 153, are not only concealed from sight of observers on or around the bridge 10, but they are rendered inaccessible such that an observer cannot remove the fasteners 152 so long as the lower chord $\mathbf{22}_1$ is in place in the channel 144. Indeed, so long as the lower chord $\mathbf{22}_1$ is in the channel 144, the fasteners 152, and particularly their tool engaging heads 153 cannot be reached with a tool or otherwise, and the fasteners are prevented from backing out of their respective apertures 150 by the lower chord $\mathbf{22}_1$.

The lower node connector $\mathbf{130}_i$ thus forms a very stable connection between the lower chord $\mathbf{22}_1$, the transverse member $\mathbf{130}_1$ and the web members $\mathbf{24}_k$, $\mathbf{24}_m$ for maintaining structural integrity throughout the lower chord $\mathbf{22}_1$. As shown in reference to FIG. 11, bolts that are used to secure diagonals and transversals are hidden so they cannot be unscrewed while the node is attached to the chord providing additional safety against thief or sabotage. Additionally, antitheft nuts can be used instead of regular nuts to secure the lower node connector $\mathbf{130}_i$ to the lower chord $\mathbf{22}_1$.

Figure 13:
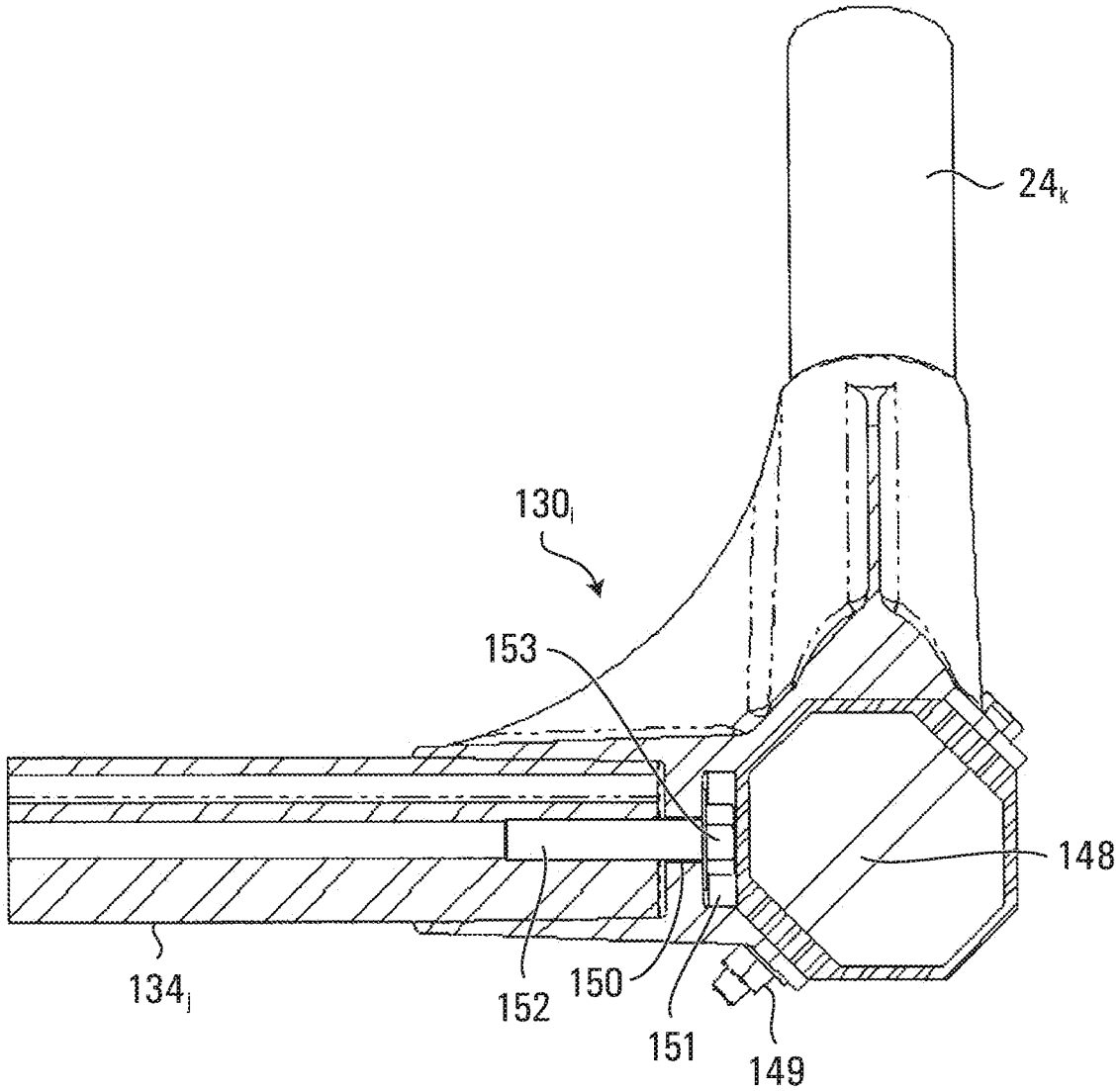
FIGS. 13 to 15 show different cross-sectional views of the lower chord, the web members, and the lower node connector.
Figure 14:
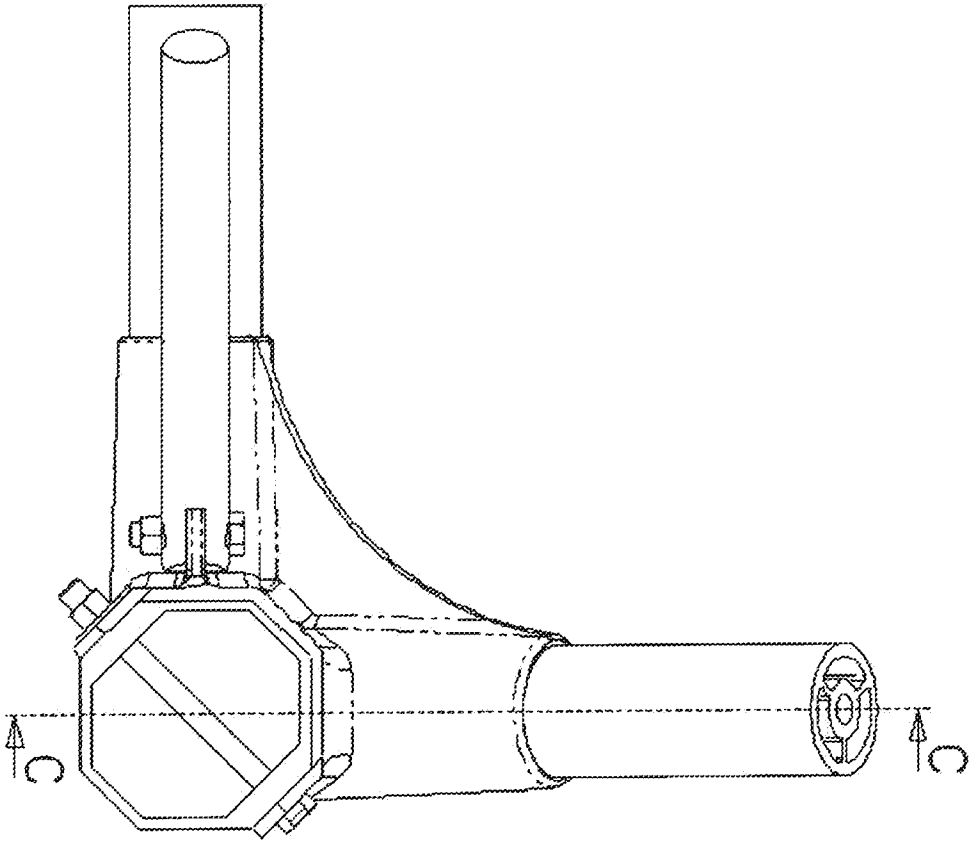
Figure 15:
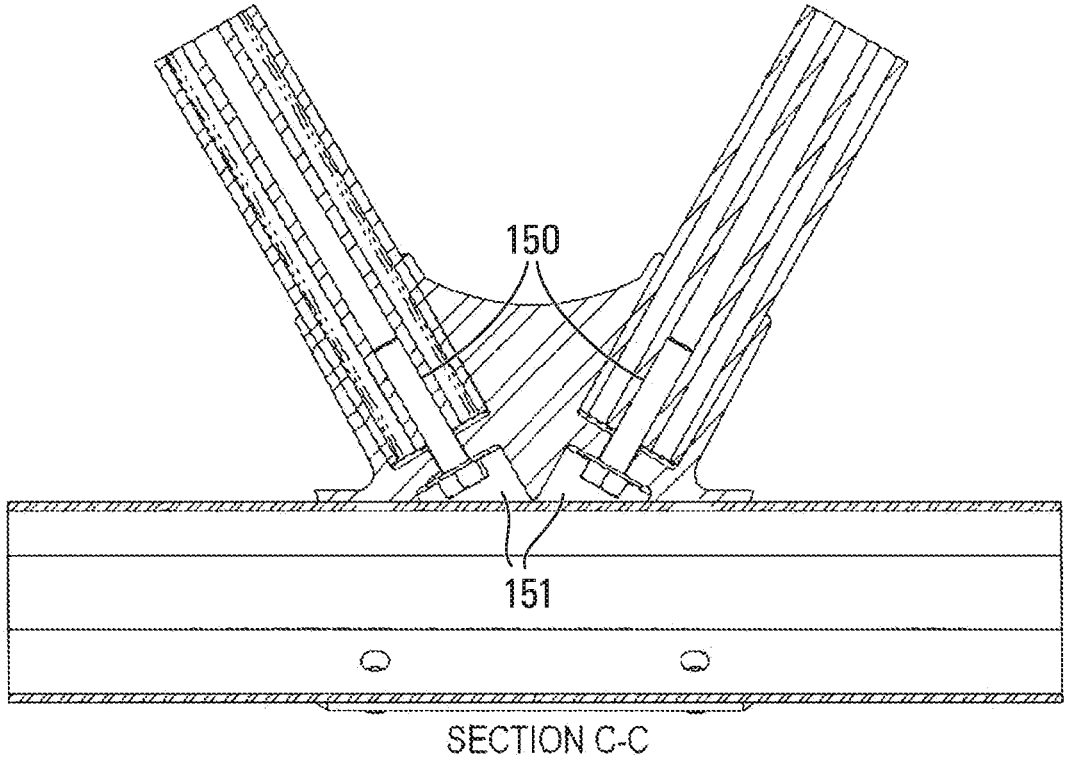

The floor diagonals $\mathbf{132}_i$, $\mathbf{132}_j$ act to resist horizontal loading act on the projected area of the bridge 10. The web members $\mathbf{24}_k$, $\mathbf{24}_m$ act to resist tension and compression forces but they also transfer some bending moment to the transverse member $\mathbf{134}_j$ as well as they transfer torsion to the lower chord $\mathbf{22}_1$ FIG. 13 shows a cross-sectional view taken along line A-A in FIG. 12. A fastener 152 is shown in this view, which in the example shown is a bolt which secures the transverse member $\mathbf{134}_j$ to the lower node connector $130_1$ in the cavity $142_1$. FIG. 14 shows a cross-sectional view taken along lines B-B in FIG. 12, while FIG. 15 shows a cross-sectional view taken along line C-C in FIG. 14.

Figure 17:
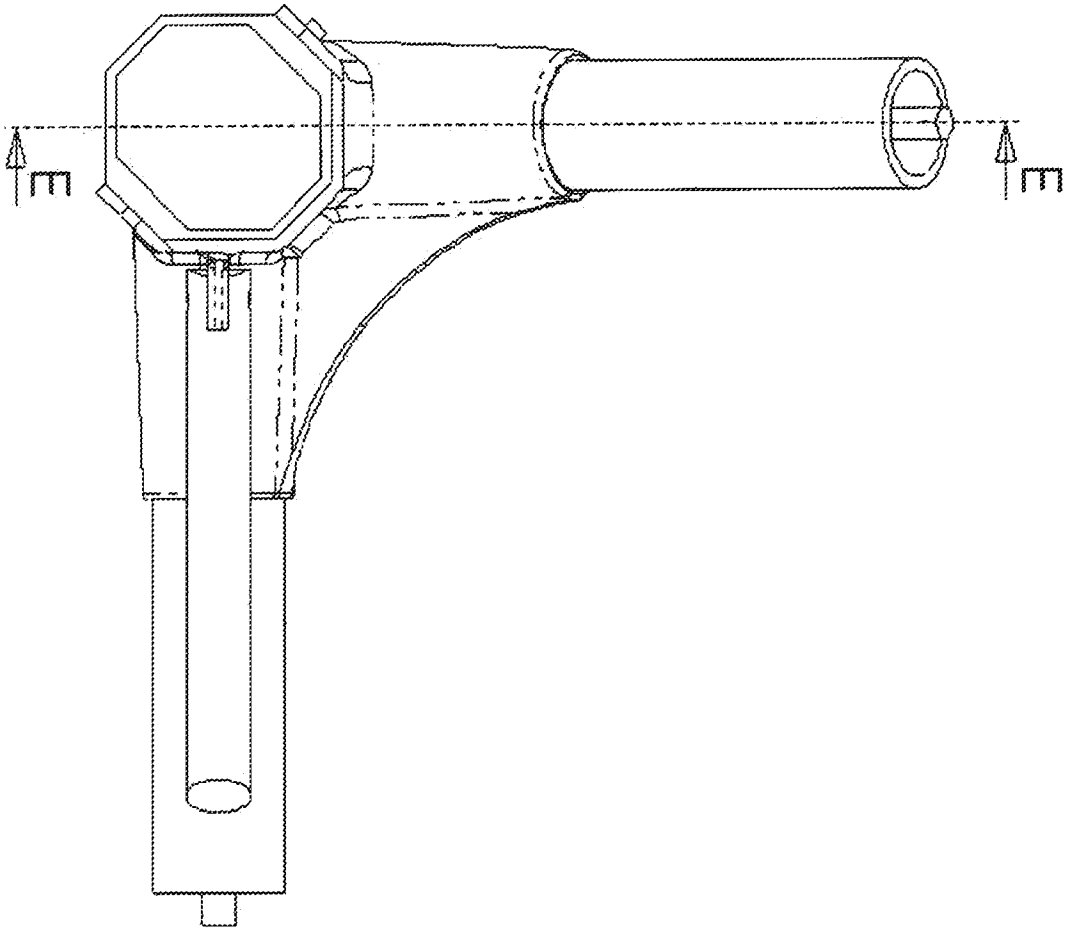
FIGS. 17 to 20 show variants for interconnecting the lower chord, the web members, and the lower node connector in accordance with other embodiments of the invention.
Figure 18:
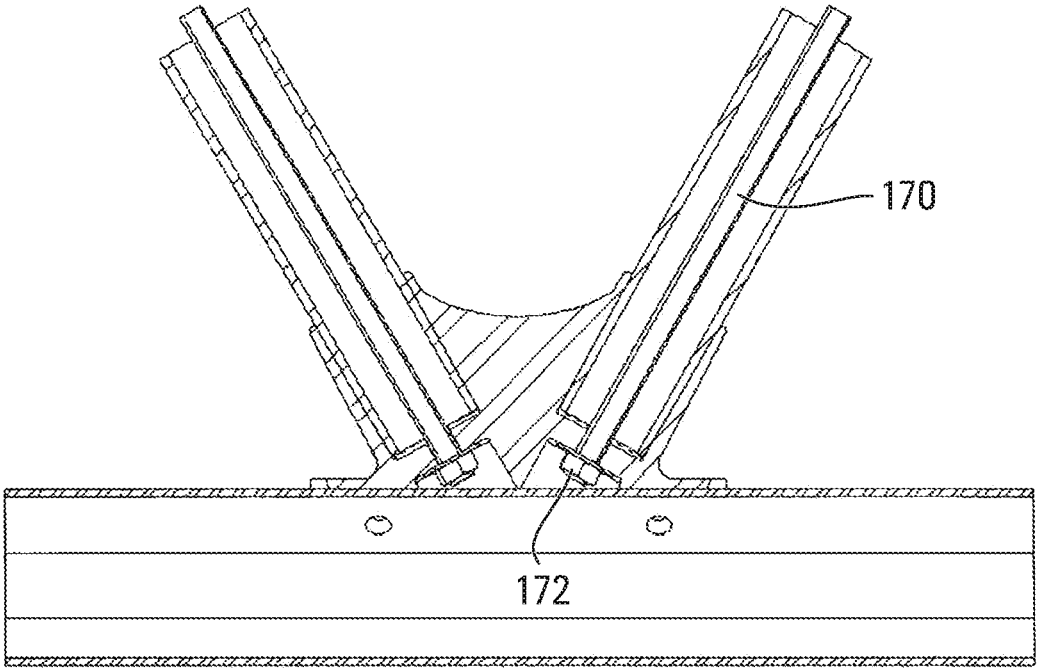
Figure 19:
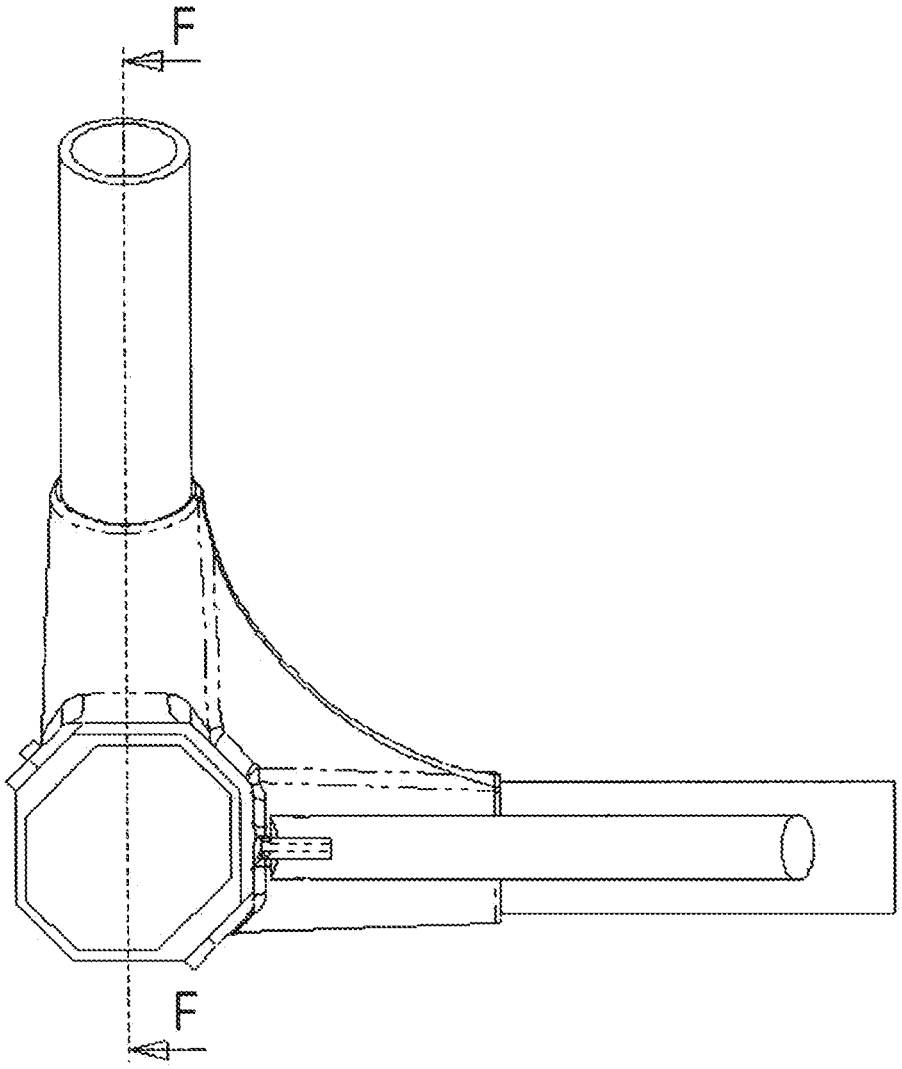
Figure 20:
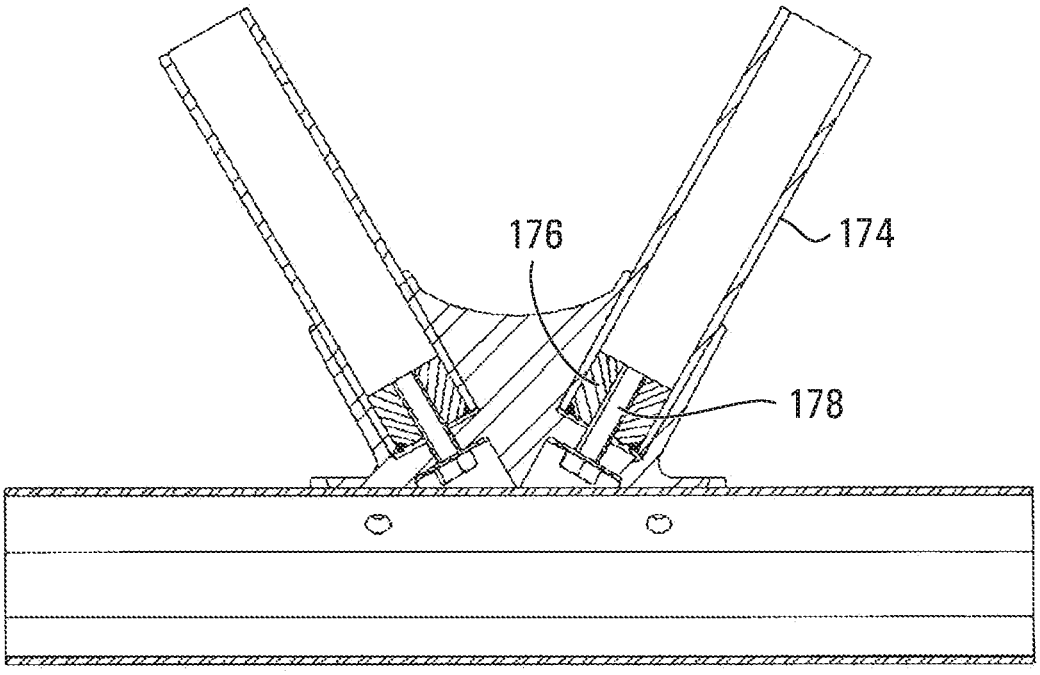

The web members $140_k$, $140_m$ and the transverse member $134_j$ may be secured to the lower node connector $130_i$ in various other ways in other embodiments. For example, FIG. 17 shows a possible variant to the use of a multi-hollow section shown in FIG. 16 for the web members $24_1$-$24_N$ or for the transverse members $134_1$-$134_S$. As shown, it may be possible to use a regular hollow shape that could be secured into a cavity by way of a rod partially or completely threaded. FIG. 18 shows a cross-sectional view taken along line E-E in FIG. 17. A rod 170 may run on or near the neutral axis of a tube. A nut 172 may give a pre-tension to maintain the tube inside the cavity with adequate pressure. As another example, FIG. 19 shows another possible variant. Here, a hollow section 174 is secured into place with using a threaded insert 176. FIG. 20 is a cross-sectional view taken along line F-F in FIG. 19. As shown, the threaded insert 176 may fit the inside of the hollow section 174. The threaded insert 176 may be maintained inside the hollow section 174 by being welded therein or by any other suitable means. The threaded insert 176 may be used to secure in place the hollow section 174 using a fastener 178, such as a bolt.

In view of the foregoing, in this embodiment, the structural assembly 12 of the bridge 10 may be a "weldless" structural assembly, i.e., it can be assembled with no welding being required to hold together its structural members. This may greatly simplify the distribution and assembly process of the bridge 10, making it suitable for uses and in locations otherwise not suited for welded bridges. Furthermore, individual components may be shipped individually for assembly, and this assembly may be performed without expensive welding services. Furthermore, the structural assembly 12 may be disassemblable, making it possible to easily relocate it or to simply take it down, opening up the prospect of installing it in non-permanent locations or even renting it.

While in this embodiment the structural assembly 12 is configured in a particular way, the structural assembly 12 may be configured in various other ways in other embodiments.

Figure 10:
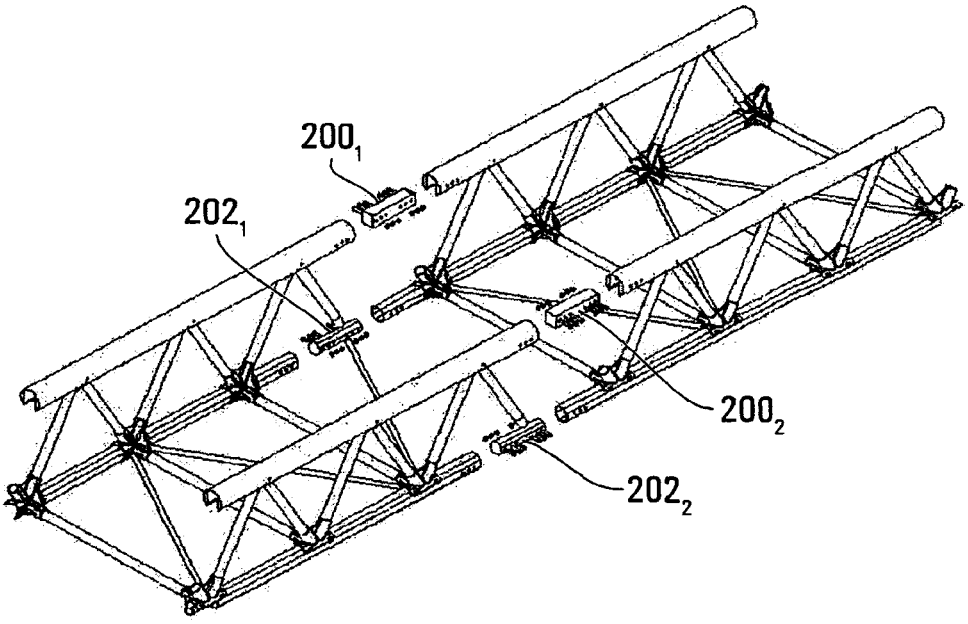
FIG. 10 shows interconnection of two sections of the bridge in accordance with another embodiment of the invention.
Figure 11:
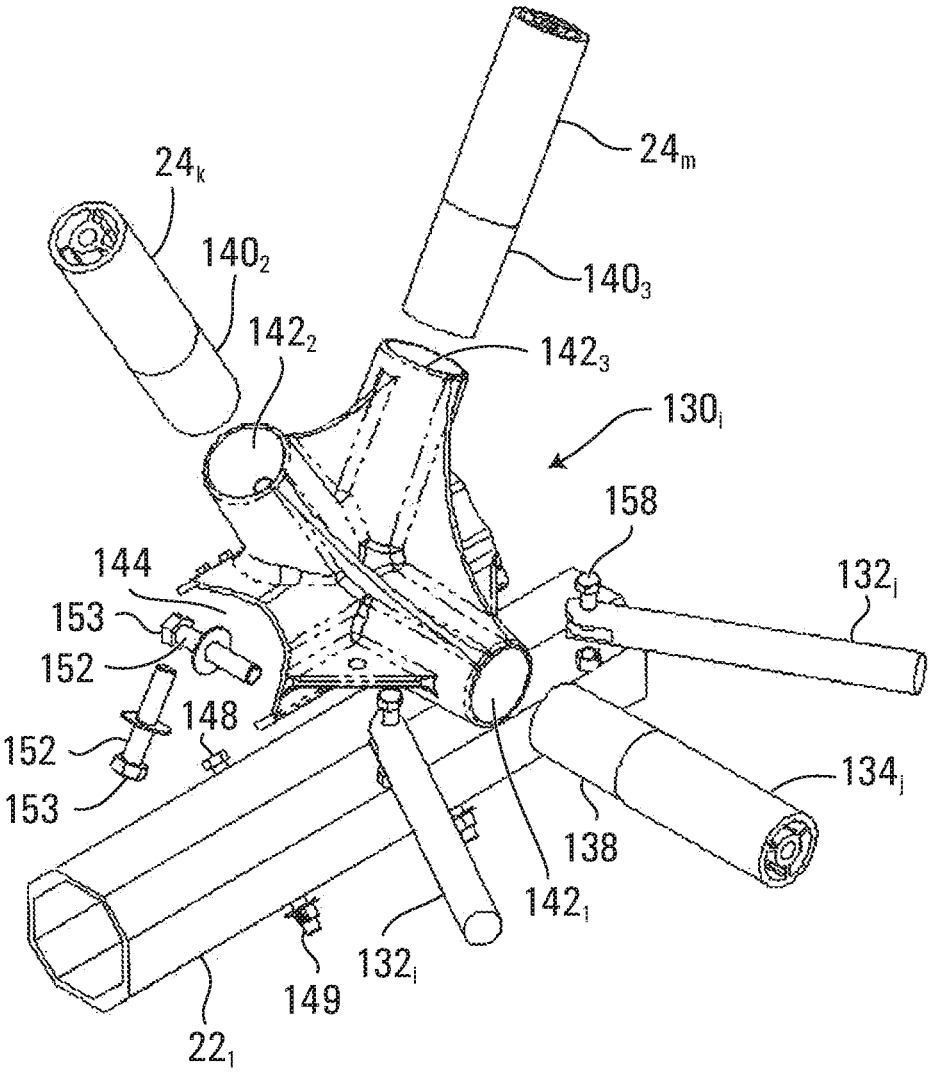
FIG. 11 shows a perspective view of a lower chord and three web members interconnected via a lower node connector.
Figure 12:
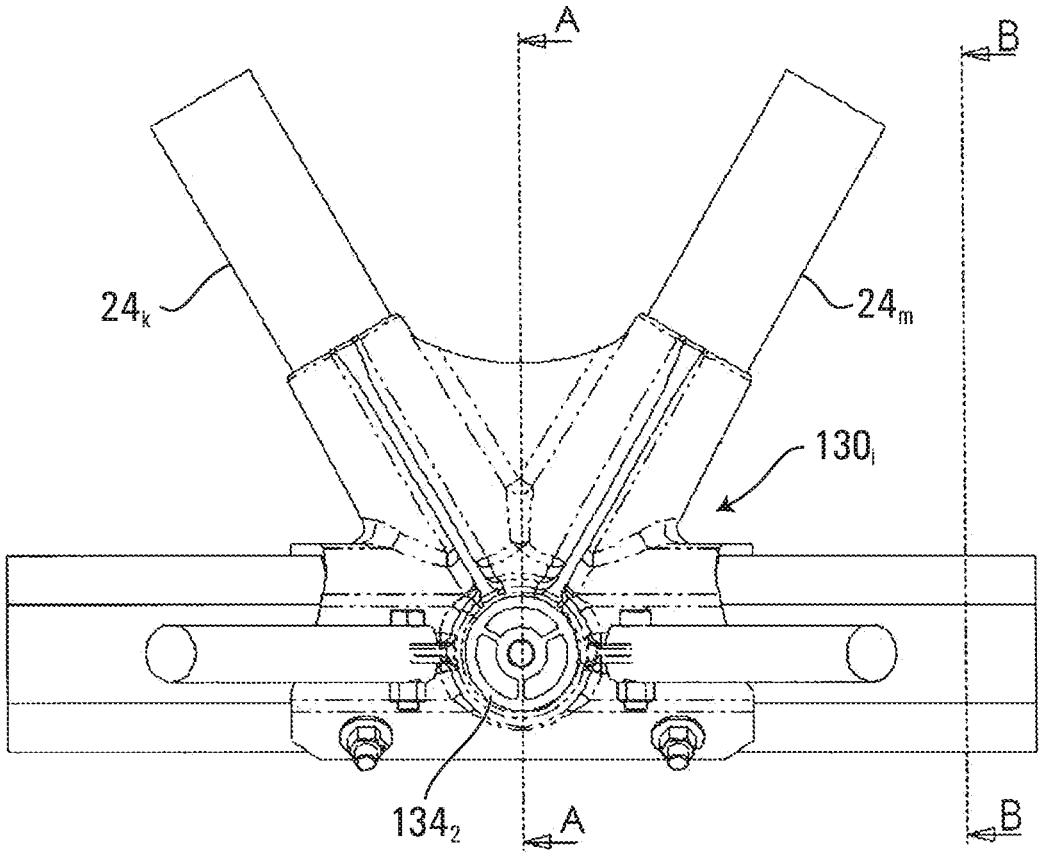
FIG. 12 shows a side elevation view of the lower chord, the web members, and the lower node connector.

For example, in some embodiments, the structural assembly 12 may comprise other structural members and components to make the bridge 10 longer. For instance, as shown in FIG. 10, in some embodiments, splices $200_1$, $200_2$ may be provided for linking upper chords of a first bridge section to respective upper chords of a second bridge sections and splices $202_1$, $202_2$ may likewise be provided for linking lower chords of the first bridge section to respective lower chords of the second bridge section. The splices $200_1$, $200_2$, $202_1$, $202_2$ may be inserts to be inserted into a first chord of a first bridge section and secured thereto such that a portion of the splice protrudes from the first chord and is inserted into a second chord of a second bridge section and secured thereto so as to effectively connect the two chords together. The splices $200_1$, $200_2$, $202_1$, $202_2$ may be secured by bolts or other fasteners, thus maintaining the weld-less nature of the bridge 10.

Figure 22:
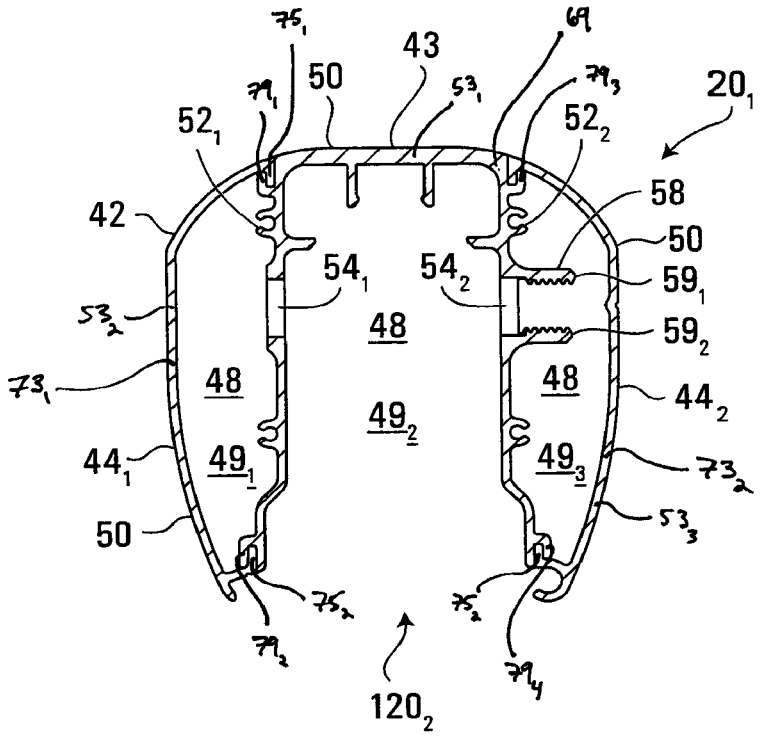
FIG. 22 shows a cross-sectional view of an upper chord in accordance with another embodiment of the invention.

As another example, although in this embodiment the upper chord $20_1$ is a one-piece member, in other embodiments, the upper chord $20_1$ may be a multi-piece member comprising a plurality of parts affixed to one another (e.g., by welding, fastening, interlocking, etc.). For instance, as shown in FIG. 22, in some embodiments, the upper chord $20_1$ may comprise a central part 69 and a pair of lateral parts $73_1$, $73_2$ connected to the central part 69. Thus, in such embodiments, the periphery 42 of the upper chord $20_1$ is defined by external surfaces of the central part 69 and the lateral parts $73_1$, $73_2$, and the internal space 48 of the upper chord $20_1$ is delimited by the central part 69 and the lateral parts $73_1$, $73_2$. Also, in such embodiments, the outer wall 50 of the upper chord $20_1$ comprises a first wall portion $53_1$ formed by the central part 69, a second wall portion $53_2$ formed by the lateral part $73_1$, and a third wall portion $53_3$ formed by the lateral part $73_2$. In this example, each of the lateral parts $73_1$, $73_2$ is interlocked with the central part 69. More particularly, in this example, the central part 69 comprises four flanges $79_1$-$79_4$ and each of the lateral parts $73_1$, $73_2$ comprises a pair of flanges $75_1$, $75_2$. The lateral part $73_1$ is interlocked with the central part 69 by engagement of its flanges $75_1$, $75_2$ with the flanges $79_1$, $79_2$ of the central part 69. The flanges $75_1$, $75_2$ of the lateral part $73_1$ may be slid into engagement with the flanges $79_1$, $79_2$ of the central part 69 by sliding the lateral part $73_1$ relative to the central part 69, or may be snap-fitted into engagement with the flanges $79_1$, $79_2$ of the central part 69. Similarly, the lateral part $73_2$ is interlocked with the central part 69 by engagement of its flanges $75_1$, $75_2$ with the flanges $79_3$, $79_4$ of the central part 69.

Figure 21:
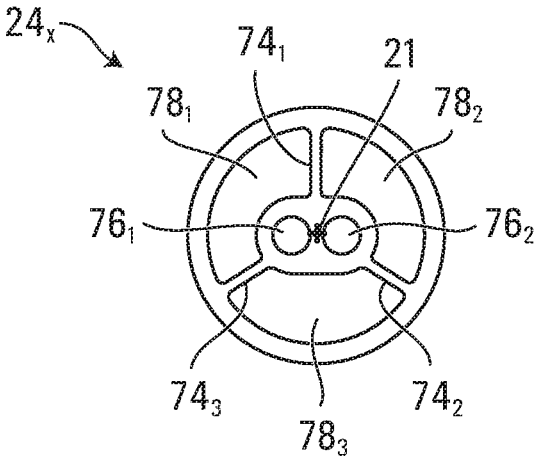
FIG. 21 shows a cross-sectional view of a web member in accordance with another embodiment of the invention.

As another example, in other embodiments, a web member $24_x$ of the web members $24_1$-$24_N$ may be connected to a connector $47_x$ of the connectors $47_1$, $47_2$ of an upper node $36_x$ of the upper nodes $36_1$-$36_P$ by two or more fasteners such as the fastener 86. For instance, as shown in FIG. 21, in some embodiments, the inner walls of the web member $24_x$ may define two interior elongated channels $76_1$, $76_2$ such as the interior elongated channel 76 which can receive two fasteners (e.g., bolts) such as the fastener 86 each generally parallel to the neutral axis 21 of the web member $24_x$ and adjacent to one another along a direction transverse to the neutral axis 21 of the web member $24_x$. The connector $47_x$ would in such embodiments comprise two apertures for receiving the two fasteners. Similarly, the web member $24_x$ may be connected to a lower node connector $130_x$ of the connectors $47_1$, $47_2$ of a lower node $38_x$ of the lower nodes $38_1$-$38_R$, by two or more fasteners such as the fastener 152. Other ones of the web members $24_1$-$24_N$, $30_1$-$30_N$, $32_1$-$32_M$ may be connected in a similar manner. Such use of two or more fasteners may provide enhanced structural rigidity and redundancy in case of failure of one of the fasteners.

As another example, although in this embodiment the lighting devices $120_1$-$120_L$ are present on the underside of the upper chord $20_1$, in other embodiments, the lighting devices $120_1$-$120_L$ of the illumination system 112 may be placed elsewhere on the bridge 10 to illuminate in any desired direction. For instance, some or all of the lighting devices $120_1$-$120_L$ may be arranged along the lower chord $22_1$ in a manner similar to that described above in respect of the upper chord $20_1$.

As another example, in some embodiments, the structural assembly 12 may support a sound system comprising one or more speakers, which may be arranged in a manner similar to the lighting devices $120_1$-$120_L$ of the illumination system 112 discussed above, with wires running inside the internal space 48 of the upper chord $20_1$ or mounted to other components (e.g., the lower chord $22_1$).

Although in this embodiment the bridge 10 is a pedestrian bridge, in other embodiments, the bridge 10 may be another type of bridge. For example, in some embodiments, the bridge 10 may be a bridge providing a pathway for vehicles (e.g., automobiles, trucks, military vehicles, etc.).

While in this embodiment the structural assembly 12 is included in a bridge, the structural assembly 12 may be part of structures other than bridges in other embodiments. For example, in other embodiments, structural assemblies such as the structural assembly 12 may part of, inter alia, buildings, fences, towers (e.g., antennae tower), gantries (e.g., motorway gantries, crane gantries, etc.), flag post bases, furniture, and various other lattice structures and other types of structures.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A structural assembly comprising:

a) an elongated member defining an internal space;

b) a plurality of framing members connected to the elongated member at a plurality of pin connection nodes, each pin connection node comprising a pin interconnecting the elongated member, a first one of the framing members, and a second one of the framing members, a first longitudinal end of the pin and a second longitudinal end of the pin being located in the internal space of the elongated member; and c) a tamperproof arrangement blocking access to the pin.

2. The structural assembly claimed in claim 1, wherein: the elongated member comprises an outer wall delimiting the internal space and comprising an opening aligned with the pin; and the tamperproof arrangement comprises a barrier blocking access to the pin through the opening.

3. The structural assembly claimed in claim 1, wherein the tamperproof arrangement comprises: a barrier-supporting portion located in the internal space; and a barrier blocking access to the pin and supported by the barrier-supporting portion.

4. The structural assembly claimed in claim 3, wherein the barrier is slidable relative to the barrier-supporting portion when mounting the structural assembly.

5. The structural assembly claimed in claim 3, wherein the barrier-supporting portion comprises a supporting projection elongated in a longitudinal direction of the elongated member and engaging the barrier.

6. The structural assembly claimed in claim 5, wherein the supporting projection extends along an entirety of a length of the elongated member.

7. The structural assembly claimed in claim 5, wherein: the supporting projection is a first supporting projection; and the barrier-supporting portion comprises a second supporting projection elongated in the longitudinal direction of the elongated member and engaging the barrier.

8. The structural assembly claimed in claim 3, wherein the elongated member is an extrusion and the barrier-supporting portion is extruded as part of the extrusion.

9. The structural assembly claimed in claim 1, wherein the elongated member is an extrusion.

10. The structural assembly claimed in claim 1, wherein the pin is concealed from view.

11. The structural assembly claimed in claim 1, wherein the elongated member comprises a pin-retaining portion located in the internal space and retaining the pin in place.

12. A bridge comprising:

a) a first chord defining an internal space;

b) a second chord;

c) a plurality of web members connected to the first chord and the second chord, the web members being connected to the first chord at a plurality of pin connection nodes, each pin connection node comprising a pin interconnecting the first chord, a first one of the web members, and a second one of the web members, a first longitudinal end of the pin and a second longitudinal end of the pin being located in the internal space of the first chord; and d) a tamperproof arrangement blocking access to the pin.

13. The bridge claimed in claim 12, wherein the web members are connected to the second chord at a plurality of moment-transferring connection nodes.

14. The bridge claimed in claim 12, wherein the bridge is a pedestrian bridge.

15. The bridge claimed in claim 12, wherein: the first chord comprises an outer wall defining the internal space and comprising an opening aligned with the pin; and the tamperproof arrangement comprises a barrier blocking access to the pin through the opening.

16. The bridge claimed in claim 12, wherein the tamperproof arrangement comprises: a barrier-supporting portion located in the internal space of the first chord; and a barrier blocking access to the pin and supported by the barrier-supporting portion.

17. The bridge claimed in claim 16, wherein the barrier is slidable relative to the barrier-supporting portion when building the bridge.

18. The bridge claimed in claim 16, wherein the barrier-supporting portion comprises a supporting projection elongated in a longitudinal direction of the first chord and engaging the barrier.

19. The bridge claimed in claim 18, wherein the supporting projection extends along an entirety of a length of the first chord.

20. The bridge claimed in claim 18, wherein: the supporting projection is a first supporting projection; and the barrier-supporting portion comprises a second supporting projection elongated in the longitudinal direction of the first chord and engaging the barrier.

21. The bridge claimed in claim 16, wherein the first chord is an extrusion and the barrier-supporting portion is extruded as part of the extrusion.

22. The bridge claimed in claim 12, wherein the first chord is an extrusion.

23. The bridge claimed in claim 12, wherein the pin is concealed from view.

24. The bridge claimed in claim 12, wherein: the outer wall defines a periphery of the first chord; the periphery of the first chord comprises a first surface and a second surface opposite one another; the opening extends from the first surface; and the outer wall is free of any opening extending from the second surface and aligned with the opening extending from the first surface.

25. The bridge claimed in claim 12, wherein the first chord comprises a pin-retaining portion located in the internal space and retaining the pin in place.

26. The bridge claimed in claim 25, wherein: the pin comprises a threaded fastener; and the pin-retaining portion comprises a thread-engaging portion engaging the threaded fastener.

* * * * *